US010279223B2

(12) United States Patent
Onuki et al.

(10) Patent No.: US 10,279,223 B2
(45) Date of Patent: May 7, 2019

(54) GOLF CLUB

(71) Applicant: SUMITOMO RUBBER INDUSTRIES, LTD., Kobe-shi, Hyogo (JP)

(72) Inventors: Masahide Onuki, Kobe (JP); Yuki Motokawa, Kobe (JP); Naruhiro Mizutani, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/792,069

(22) Filed: Oct. 24, 2017

(65) Prior Publication Data

US 2018/0117423 A1 May 3, 2018

(30) Foreign Application Priority Data

Nov. 2, 2016 (JP) ..... 2016-214764

(51) Int. Cl.
*A63B 53/02* (2015.01)
*A63B 60/42* (2015.01)
(Continued)

(52) U.S. Cl.
CPC ..... *A63B 53/02* (2013.01); *A63B 53/04* (2013.01); *A63B 60/42* (2015.10); *A63B 53/047* (2013.01);
(Continued)

(58) Field of Classification Search
CPC ..... A63B 53/02; A63B 60/42; A63B 53/04; A63B 53/0466; A63B 53/047;
(Continued)

(56) References Cited

U.S. PATENT DOCUMENTS 6,575,843 B2 * 6/2003 McCabe ..... A63B 53/02 473/245
8,272,972 B2 * 9/2012 Sato ..... A63B 53/02 473/296
(Continued)

FOREIGN PATENT DOCUMENTS

JP 2002186689 A * 7/2002
JP 2006042950 A * 2/2006
(Continued)

*Primary Examiner* — Stephen L Blau
(74) *Attorney, Agent, or Firm* — Birch, Stewart, Kolasch & Birch, LLP

(57) ABSTRACT

A golf club 100 includes a head 200 having a hosel part 202, a shaft 300, and a reverse-tapered engagement part RT. The reverse-tapered engagement part RT includes a sleeve 400 having a reverse-tapered shape and being fixed to a tip portion of the shaft 300, and a spacer fitted outside of the sleeve 400. The hosel part 202 includes a hosel hole 204 and a hosel slit 206 which is provided on a side of the hosel hole 204 and enables the shaft 300 to pass through the hosel slit. The hosel hole 204 has a reverse-tapered hole 205 having a shape corresponding to a shape of an outer surface of the reverse-tapered engagement part RT. The reverse-tapered engagement part RT is fitted to the reverse-tapered hole 205. A club length is changed by changing a wall thickness of the spacer.

11 Claims, 20 Drawing Sheets

(51) Int. Cl.

| | |
|---|---|
| ***A63B 53/04*** | (2015.01) |
| *A63B 53/06* | (2015.01) |
| *A63B 53/10* | (2015.01) |
| *A63B 53/12* | (2015.01) |

(52) U.S. Cl.
CPC ..... *A63B 53/0466* (2013.01); *A63B 53/065* (2013.01); *A63B 53/10* (2013.01); *A63B 53/12* (2013.01); *A63B 2225/09* (2013.01)

(58) Field of Classification Search
CPC ..... A63B 53/065; A63B 53/10; A63B 53/12; A63B 2225/09
See application file for complete search history.

(56) References Cited

U.S. PATENT DOCUMENTS 8,382,607 B2 * 2/2013 Burnett ..... A63B 53/06 473/307
8,517,856 B2 * 8/2013 Bennett ..... A63B 53/02 473/307
8,562,453 B2 * 10/2013 Sato ..... A63B 53/02 473/288
8,696,488 B2 * 4/2014 Burnett ..... A63B 53/06 473/307
8,795,099 B2 * 8/2014 Sato ..... A63B 53/02 473/307
8,852,020 B2 * 10/2014 Bennett ..... A63B 53/02 473/296
8,936,514 B2 * 1/2015 Sato ..... A63B 53/06 473/296
9,814,943 B2 * 11/2017 Onuki ..... A63B 53/0466
10,004,951 B2 * 6/2018 Moore ..... F16L 27/02
2006/0247071 A1 * 11/2006 Womersley ..... A63B 53/02 473/340
2010/0016094 A1 * 1/2010 Hocknell ..... A63B 53/00 473/288
2010/0234123 A1 9/2010 Sato et al.
2012/0088598 A1 * 4/2012 Lo ..... A63B 53/02 473/307
2012/0142445 A1 6/2012 Burnett et al.
2013/0210540 A1 * 8/2013 Baumann ..... A63B 53/007 473/319
2014/0051527 A1 * 2/2014 Sato ..... A63B 53/02 473/307
2014/0162805 A1 * 6/2014 Kitagawa ..... A63B 53/0466 473/307
2014/0162806 A1 * 6/2014 Kitagawa ..... A63B 53/02 473/307
2015/0005097 A1 * 1/2015 Motokawa ..... A63B 60/00 473/338
2018/0161650 A1 * 6/2018 Beach ..... A63B 53/02

FOREIGN PATENT DOCUMENTS

JP 2010-213859 A 9/2010
JP 2014-36809 A 2/2014

* cited by examiner

GOLF CLUB

The present application claims priority on Patent Application No. 2016-214764 filed in JAPAN on Nov. 2, 2016, the entire contents of which are hereby incorporated by reference.

BACKGROUND OF THE INVENTION

Field of the Invention

The present invention relates to a golf club.

Description of the Related Art

A golf club including a shaft attaching/detaching mechanism to which a club length adjustment mechanism is added has been proposed.

Japanese Patent Application Publication No. 2010-213859 (US2010/0234123) discloses a golf club having a spacer bonded to a tip of a shaft, a first screw member capable of being screw-connected to an upper end part of a hosel, and a second screw member capable of being screw-connected to both the first screw member and the upper end part of the hosel.

Japanese Patent Application Publication No. 2014-36809 (US2014/0051527) discloses a golf club including a shaft case fixed to a tip portion of a shaft, and a spacer having a plurality of slits each having a different depth from each other.

US2012/0142445 discloses a golf club: in which a spacer capable of connecting to a retainer and to a shaft sleeve is provided at a lower end of the shaft sleeve; and a hosel sleeve is provided on an upper part of a hosel.

SUMMARY OF THE INVENTION

An object of the present disclosure is to provide a golf club in which a combination of a shaft attaching/detaching mechanism and a club length adjustment mechanism can be achieved without a complex structure.

In one aspect, a golf club may include a head having a hosel part, a shaft, and a reverse-tapered engagement part disposed at a tip portion of the shaft. The reverse-tapered engagement part may include: a sleeve which has a reverse-tapered shape and is fixed to the tip portion of the shaft; and a spacer fitted outside of the sleeve. The hosel part may include a hosel hole, and a hosel slit which is provided on a side of the hosel hole and enables the shaft to pass through the hosel slit. The hosel hole may have a reverse-tapered hole having a shape corresponding to a shape of an outer surface of the reverse-tapered engagement part. The reverse-tapered engagement part may be fitted to the reverse-tapered hole. In the golf club, club length may be changed by changing a wall thickness of the spacer.

In another aspect, a length of the spacer may be changed with the change of the wall thickness of the spacer.

In another aspect, the reverse-tapered engagement part may further include an extension sleeve to be attached to a butt end of the sleeve. The extension sleeve may be fitted inside of the spacer.

In another aspect, a recess may be provided on a side surface of the extension sleeve.

In another aspect, an axial-direction position of a lower end surface of the reverse-tapered engagement part may be the same regardless of club length.

In another aspect, the golf club may include a first extension sleeve and a second extension sleeve as the extension sleeve. The head may have an extension-sleeve port to which the first extension sleeve and the second extension sleeve can be alternatively attached.

In another aspect, the second extension sleeve may be longer than the first extension sleeve. The second extension sleeve may be heavier than the first extension sleeve.

BRIEF DESCRIPTION OF THE DRAWINGS

FIG. 5(*a*) is a sectional view of the golf club in a state where the club length is minimum, FIG. 5(*b*) is a sectional view of the golf club in a state where the club length is medium, and FIG. 5(*c*) is a sectional view of the golf club in a state where the club length is maximum;

FIG. 10(*a*) is a sectional view of the golf club in a state where the club length is minimum, FIG. 10(*b*) is a sectional view of the golf club in a state where the club length is medium, and FIG. 10(*c*) is a sectional view of the golf club in a state where the club length is maximum;

DESCRIPTION OF THE PREFERRED EMBODIMENTS

Figure 1:
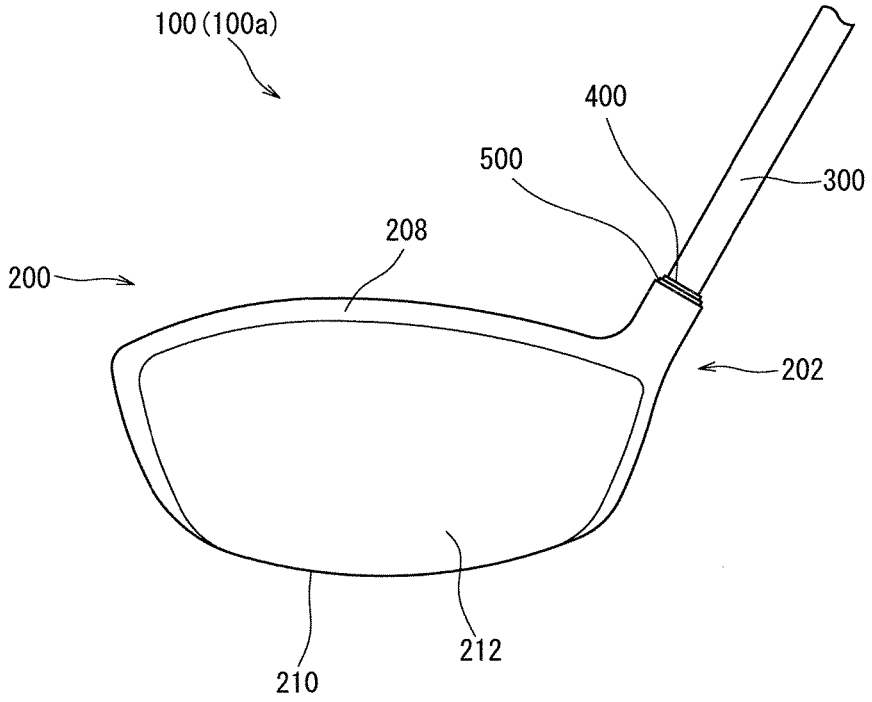
FIG. 1 is a front view of a golf club according to a first embodiment.

In a shaft attaching/detaching mechanism, a sleeve is fixed by using a screw. The screw may be connected to the sleeve from a lower side (sole side), or may be connected to the sleeve from an upper side (grip side).

A large centrifugal force acts on a head during swinging. In addition, a strong impact shock force caused by hitting acts on the head. A screw having sufficient strength is required so that the screw can endure the centrifugal force and the impact shock force. A screw having sufficient strength has a large mass. The mass of the screw hinders the weight saving of the head. The mass of the screw reduces the degree of freedom of the weight distribution of the head. The weight saving becomes more difficult by adding a club length adjustment mechanism to such an attaching/detaching mechanism. Thus, the degree of freedom of the weight distribution of the head is reduced and the degree of freedom in design of the head is also decreased.

In the type of a shaft attaching/detaching mechanism in which the shaft is fixed with a screw from a lower side, a position of the sleeve is changed with change of the club length. In this case, a long screw is required to be suited to the change of the sleeve position. For this reason, the mass of the screw is further increased. When the club length is made longer, the sleeve is located on an upper position. In this case, of a screw, a portion which is not screwed into the sleeve becomes large. Since not only the screw is long but also the portion which is not screwed into a screw hole is increased, load on the screw is further increased. As a result, strength and endurance tend to deteriorate.

In the type of the shaft attaching/detaching mechanism in which the shaft is fixed with a screw from a lower side, an angle adjustment mechanism can also be added. A shaft axis is inclined by inclining a shaft hole provided in the sleeve. A loft angle, a lie angle, and a face angle can be adjusted by changing a rotation position of the sleeve having the inclined shaft axis. When change in the inclination direction of the shaft axis is large, the position and the direction of the screw are also largely changed. When the changes in the position and the angle of the screw are large, a surface on which a head part of the screw abuts cannot follow the changes in the position and the angle of the screw. For this reason, coaxial properties between the screw and a sleeve are lost, and deformation in which the screw or the sleeve is bent is imposed. The constitution may reduce the strength and the endurance of a shaft fixing structure. Due to the problem, the position and the angle of the screw are limited. That is, the adjustment ranges of a loft angle and the like are restrained. If the angle adjustment mechanism and the club length adjustment mechanism are combined, a large load is put on the long screw and thereby the strength and endurance further tend to deteriorate.

Thus, the problem of the conventional shaft attaching/detaching mechanism is further emphasized by adding the club length adjustment mechanism. That is, if the club length adjustment mechanism is incorporated to the conventional shaft attaching/detaching mechanism, not only the problem of restraint of the angle adjustment is not solved, but also the structure becomes further complicated, and thereby the strength and endurance can further deteriorate.

Hereinafter, the present disclosure will be described in detail according to the preferred embodiments with appropriate references to the accompanying drawings.

Unless otherwise described, "a circumferential direction" in the present application means a circumferential direction of a shaft. Unless otherwise described, "an axial direction" in the present application means an axial direction of the shaft. Unless otherwise described, "an axial orthogonal direction" in the present application means a direction orthogonally crossing the axial direction of the shaft. Unless otherwise described, a section in the present application means a section along a plane perpendicular to an axis line of the shaft. Unless otherwise described, a grip side in the axial direction of the shaft is defined as an upper side, and a sole side in the axial direction of the shaft is defined as a lower side.

Figure 2:
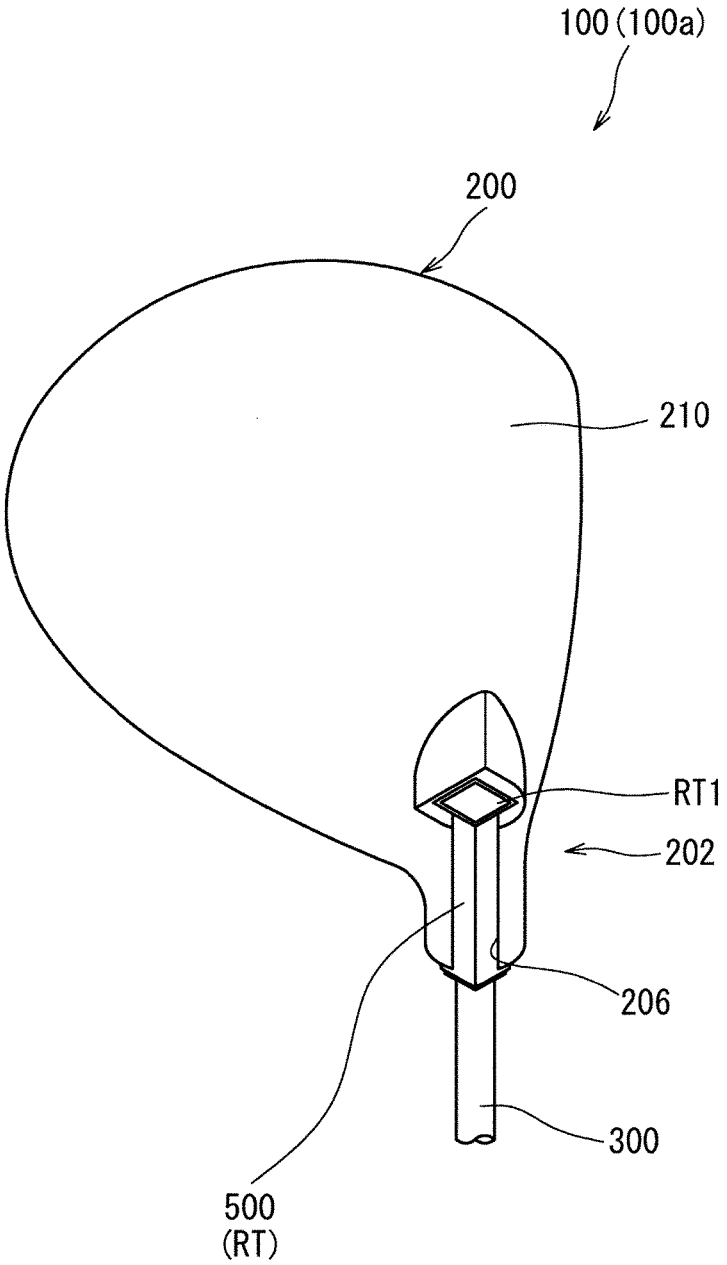
FIG. 2 is a perspective view of the golf club in FIG. 1 as viewed from a sole side.
Figure 3:
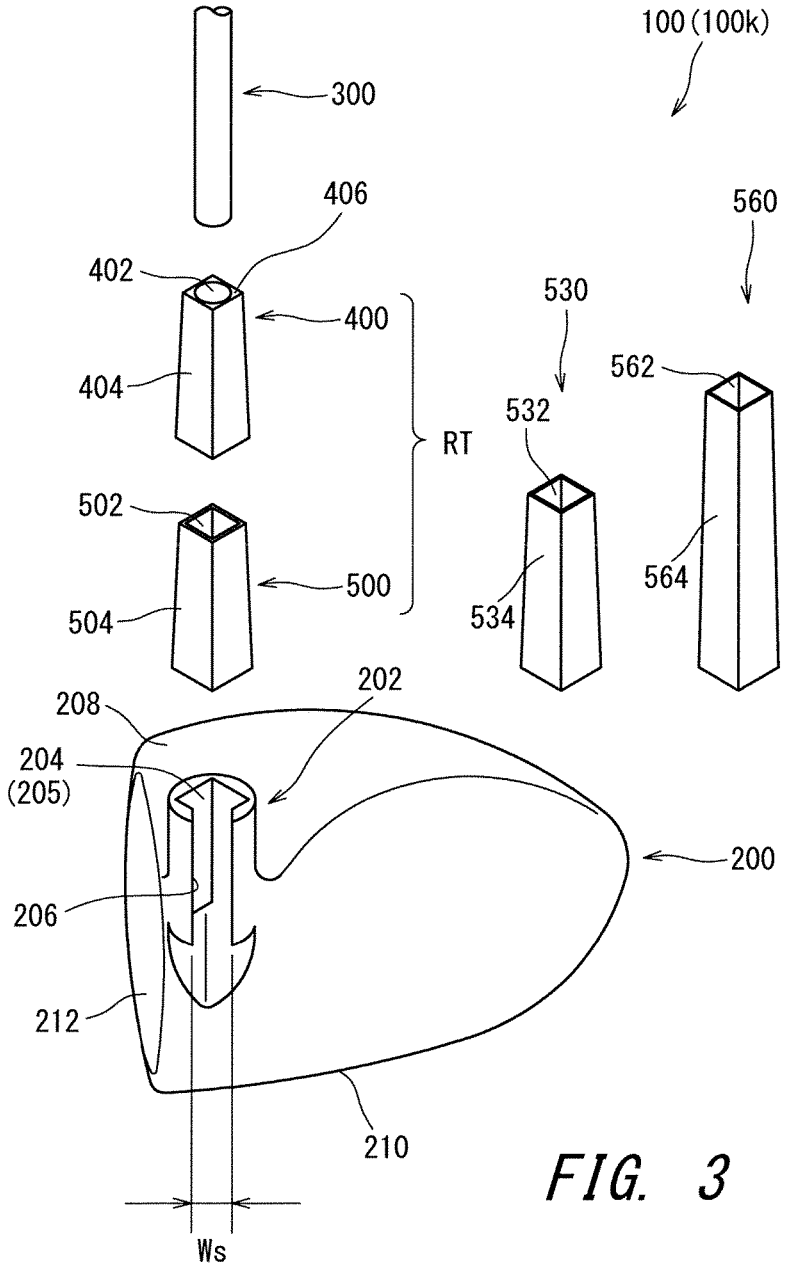
FIG. 3 is an exploded perspective view of a golf club kit including the golf club in FIG. 1 and replacement spacers, and FIG. 3 includes an exploded perspective view of the golf club in FIG. 1.

FIG. 1 shows a golf club 100 which is a first embodiment of the present disclosure. FIG. 1 shows only the vicinity of a head of the golf club 100. FIG. 2 is a perspective view of the golf club 100 as viewed from a sole side. FIG. 3 is an exploded perspective view of the golf club 100.

The golf club 100 has a head 200, a shaft 300, a sleeve 400, a spacer 500, and a grip (not shown in the drawings). The sleeve 400 and the spacer 500 constitute a reverse-tapered engagement part RT. The reverse-tapered engagement part RT is disposed at a tip portion of the shaft 300. An outer surface of the reverse-tapered engagement part RT is formed by the spacer 500.

The type of the head 200 is not limited. The head 200 of the present embodiment is a wood type head. The head 200 may be a hybrid type head, an iron type head, and a putter head or the like. The wood type head may be a driver head, or may be a head of a fairway wood.

The shaft 300 is not limited, and for example, a carbon shaft and a steel shaft may be used.

Although not shown in the drawings, the shaft 300 has a tapered shape. The shaft 300 has a diameter increasing toward the grip side. The sleeve 400 is fixed to the tip portion of the shaft 300. The tip portion of the shaft 300 is a thinnest portion in the shaft 300.

In the golf club 100, the number of the spacers 500 actually used is 1. However, replacement spacers 530 and 560 are prepared.

In the present application, in a state where a shaft is attached to a head, the number of spacers actually used is defined as N1. In the golf club 100, N1 is 1. N1 may be 2. N1 may be 3 or more. In light of weight saving of the reverse-tapered engagement part RT, N1 is preferably 1 or 2, and more preferably 1.

As shown in FIG. 3, a golf club kit 100*k* according to the golf club 100 includes the replacement spacers 530 and 560 in addition to the spacer 500. The golf club kit 100*k* is constituted with at least one replacement spacer and the golf club 100. The golf club kit 100*k* includes a plurality of (three) spacers 500, 530 and 560. The respective three spacers including the two replacement spacers are also referred to as a first spacer 500, a second spacer 530, and a third spacer 560.

In the present application, the total number of spacers in the golf club kit 100*k* is defined as N2. In the golf club kit 100*k*, N2 is 3. In light of diversity of club length, N2 is preferably equal to or greater than 2, and more preferably equal to or greater than 3. If respective variations by length adjustment are too small, the significance of the length adjustment declines. In light of strength, it is not preferable that the length of the spacer is excessively large. In view of these points, N2 is preferably equal to or less than 6, more preferably equal to or less than 5, and still more preferably equal to or less than 4.

In the present application, the number of the replacement spacers is defined as N3. In the golf club kit 100*k*, N3 is 2. In light of diversity of club length, N3 is preferably equal to or greater than 1, and more preferably equal to or greater than 2. If respective variations by length adjustment are too small, the significance of the length adjustment declines. In light of strength, it is not preferable that the length of the spacer is excessively large. In view of these points, N3 is preferably equal to or less than 5, more preferably equal to or less than 4, and still more preferably equal to or less than 3. The formula N3=N2−N1 is satisfied.

In the golf club 100, the club length can be adjusted. In the golf club 100, the club length can be adjusted to three kinds of lengths. The number of kinds of club lengths to be adjusted is represented by M. In light of preventing N2 from becoming excessively large, M is preferably equal to or less than 6, more preferably equal to or less than 5, and still more preferably equal to or less than 4. In light of adjustability, M is preferably equal to or greater than 2, and more preferably equal to or greater than 3. If N1 is 1, M is preferably equal to N2.

The head 200 has a hosel part 202. As shown in FIG. 3, the hosel part 202 has a hosel hole 204. The hosel hole 204 has a reverse-tapered hole 205. The shape of the reverse-tapered hole 205 corresponds to the shape of the outer surface of the reverse-tapered engagement part RT. In other words, the shape of the reverse-tapered hole 205 corresponds to the shape of an outer surface of the spacer 500. In the engagement state, the outer surface of the reverse-tapered engagement part RT (the outer surface of the spacer 500) is brought into surface-contact with the reverse-tapered hole 205. The outer surface of the reverse-tapered engagement part RT has a plurality of (four) planes, and all of the planes are brought into surface-contact with the reverse-tapered hole 205 (hosel hole 204).

As shown in FIG. 2 and FIG. 3, the hosel part 202 has a hosel slit 206. The hosel slit 206 is provided on a side of the hosel part 202. The hosel slit 206 is an opening which communicates between the inside of the hosel hole 204 and the outside of the head. The hosel slit 206 is opened to an axial-direction upper side, and is also opened to an axial-direction lower side. The hosel slit 206 is provided on the heel side of the hosel part 202. By the hosel slit 206, a part of the reverse-tapered hole 205 is lacked.

A width Ws of the hosel slit 206 is shown in FIG. 3. The width Ws is greater than the diameter of the thinnest portion of the shaft 300. For this reason, the hosel slit 206 enables the shaft 300 to pass through the hosel slit 206. The hosel slit 206 enables the shaft 300 moving in an axial orthogonal direction to pass through the hosel slit 206. The axial orthogonal direction means a direction orthogonal to the axis line of the shaft 300.

By the hosel slit 206, a part of the reverse-tapered hole 205 (hosel hole 204) in the circumferential direction is lacked. From the viewpoint of improving the holding properties of the reverse-tapered engagement part RT, the width Ws is preferably smaller. For example, it is just required that the width Ws is greater than a thinnest portion of an exposed part of the shaft 300 (for example, a portion adjacent to the reverse-tapered engagement part RT). The exposed part means a portion to which the sleeve and the grip are not attached and which is exposed to the outside. Needless to say, the width Ws is set such that the reverse-tapered engagement part RT cannot pass through the hosel slit 206. The reverse-tapered engagement part RT cannot pass through the hosel slit 206.

As with a usual head, the head 200 has a crown 208, a sole 210, and a face 212 (see FIGS. 1 to 3).

As shown in FIG. 3, the sleeve 400 has an inner surface 402, an outer surface 404, and an upper end surface 406. The inner surface 402 forms a shaft hole. The sectional shape of the inner surface 402 is a circle. The shape of the inner surface 402 corresponds to the shape of an outer surface of the shaft 300. The inner surface 402 is fixed to the tip portion of the shaft 300. That is, the sleeve 400 is fixed to the tip portion of the shaft 300. An adhesive is used for the fixation. The sleeve may be detachable from the shaft. For example, the shaft hole of the sleeve may be a female screw, and the tip portion of the shaft may be a male screw which can be connected to the female screw.

The outer surface 404 is a pyramid surface. The outer surface 404 is a four-sided pyramid surface. The sectional shape of the outer surface 404 is a non-circle. The sectional shape of the outer surface 404 is a polygon (regular polygon). The sectional shape of the outer surface 404 is a tetragon. The sectional shape of the outer surface 404 is a square. The area of a figure formed by a sectional line of the outer surface 404 is increased toward a lower side (sole side). That is, the sleeve 400 has a reverse-tapered shape.

As shown in FIG. 3, the spacer 500 (first spacer 500) has an inner surface 502 and an outer surface 504. The inner surface 502 forms a sleeve hole. The sectional shape of the inner surface 502 corresponds to the sectional shape of the outer surface 404 of the sleeve 400. The outer surface 404 of the sleeve 400 is fitted to the inner surface 502. In other words, the sleeve 400 is fitted inside of the spacer 500. The spacer 500 is not bonded to the sleeve 400. The spacer 500 is merely brought into contact with the sleeve 400.

The shape of the inner surface 502 corresponds to the shape of the outer surface 404 of the sleeve 400. The inner surface 502 is a pyramid surface. The inner surface 502 is a four-sided pyramid surface. The sectional shape of the inner surface 502 is a non-circle. The sectional shape of the inner surface 502 is a polygon (regular polygon). The sectional shape of the inner surface 502 is a tetragon. The sectional shape of the inner surface 502 is a square. The area of a figure formed by a sectional line of the inner surface 502 is increased toward the lower side (sole side).

The shape of the outer surface 504 (outer surface of the reverse-tapered engagement part RT) corresponds to the shape of the reverse-tapered hole 205. The outer surface 504 is a pyramid surface. The outer surface 504 is a four-sided pyramid surface. The sectional shape of the outer surface 504 is a non-circle. The sectional shape of the outer surface 504 is a polygon (regular polygon). The sectional shape of the outer surface 504 is a tetragon. The sectional shape of the outer surface 504 is a square. The area of a figure formed by a sectional line of the outer surface 504 is increased toward the lower side (sole side). That is, the spacer 500 has a reverse-tapered shape. The sleeve 400 and the spacer 500 constitute the reverse-tapered engagement part RT.

The second spacer 530 can be used by replacing the first spacer 500 with the second spacer 530. The second spacer 530 is the same as the first spacer 500 except for a length L and a wall thickness T. The second spacer 530 has an inner surface 532 and an outer surface 534. The inner surface 532 forms the sleeve hole. The sectional shape of the inner surface 532 corresponds to the sectional shape of the outer surface 404 of the sleeve 400. The outer surface 404 of the sleeve 400 is fitted to the inner surface 532. In other words, the sleeve 400 is fitted inside of the spacer 530. The spacer 530 is not bonded to the sleeve 400. The spacer 530 is merely brought into contact with the sleeve 400.

The shape of the inner surface 532 corresponds to the shape of the outer surface 404 of the sleeve 400. The inner surface 532 is a pyramid surface. The inner surface 532 is a four-sided pyramid surface. The sectional shape of the inner surface 532 is a non-circle. The sectional shape of the inner surface 532 is a polygon (regular polygon). The sectional shape of the inner surface 532 is a tetragon. The sectional shape of the inner surface 532 is a square. The area of a figure formed by a sectional line of the inner surface 532 is increased toward the lower side (sole side).

The shape of the outer surface 534 (outer surface of the reverse-tapered engagement part RT) corresponds to the shape of the reverse-tapered hole 205. The outer surface 534 is a pyramid surface. The outer surface 534 is a four-sided pyramid surface. The sectional shape of the outer surface 534 is a non-circle. The sectional shape of the outer surface 534 is a polygon (regular polygon). The sectional shape of the outer surface 534 is a tetragon. The sectional shape of the outer surface 534 is a square. The area of a figure formed by a sectional line of the outer surface 534 is increased toward the lower side (sole side). That is, the spacer 530 has a reverse-tapered shape. The sleeve 400 and the spacer 530 constitute the reverse-tapered engagement part RT.

The third spacer 560 can be used by replacing the first spacer 500 with the third spacer 560. The third spacer 560 is the same as the first spacer 500 except for the length L and the wall thickness T. The third spacer 560 is the same as the second spacer 530 except for the length L and the wall thickness T. The third spacer 560 has an inner surface 562 and an outer surface 564. The inner surface 562 forms the sleeve hole. The sectional shape of the inner surface 562 corresponds to the sectional shape of the outer surface 404 of the sleeve 400. The outer surface 404 of the sleeve 400 is fitted to the inner surface 562. In other words, the sleeve 400 is fitted inside of the spacer 560. The spacer 560 is not bonded to the sleeve 400. The spacer 560 is merely brought into contact with the sleeve 400.

The shape of the inner surface 562 corresponds to the shape of the outer surface 404 of the sleeve 400. The inner surface 562 is a pyramid surface. The inner surface 562 is a four-sided pyramid surface. The sectional shape of the inner surface 562 is a non-circle. The sectional shape of the inner surface 562 is a polygon (regular polygon). The sectional shape of the inner surface 562 is a tetragon. The sectional shape of the inner surface 562 is a square. The area of a figure formed by a sectional line of the inner surface 562 is increased toward the lower side (sole side).

The shape of the outer surface 564 (outer surface of the reverse-tapered engagement part RT) corresponds to the shape of the reverse-tapered hole 205. The outer surface 564 is a pyramid surface. The outer surface 564 is a four-sided pyramid surface. The sectional shape of the outer surface 564 is a non-circle. The sectional shape of the outer surface 564 is a polygon (regular polygon). The sectional shape of the outer surface 564 is a tetragon. The sectional shape of the outer surface 564 is a square. The area of a figure formed by a sectional line of the outer surface 564 is increased toward the lower side (sole side). That is, the spacer 560 has a reverse-tapered shape. The sleeve 400 and the spacer 560 constitute the reverse-tapered engagement part RT.

Figure 4:
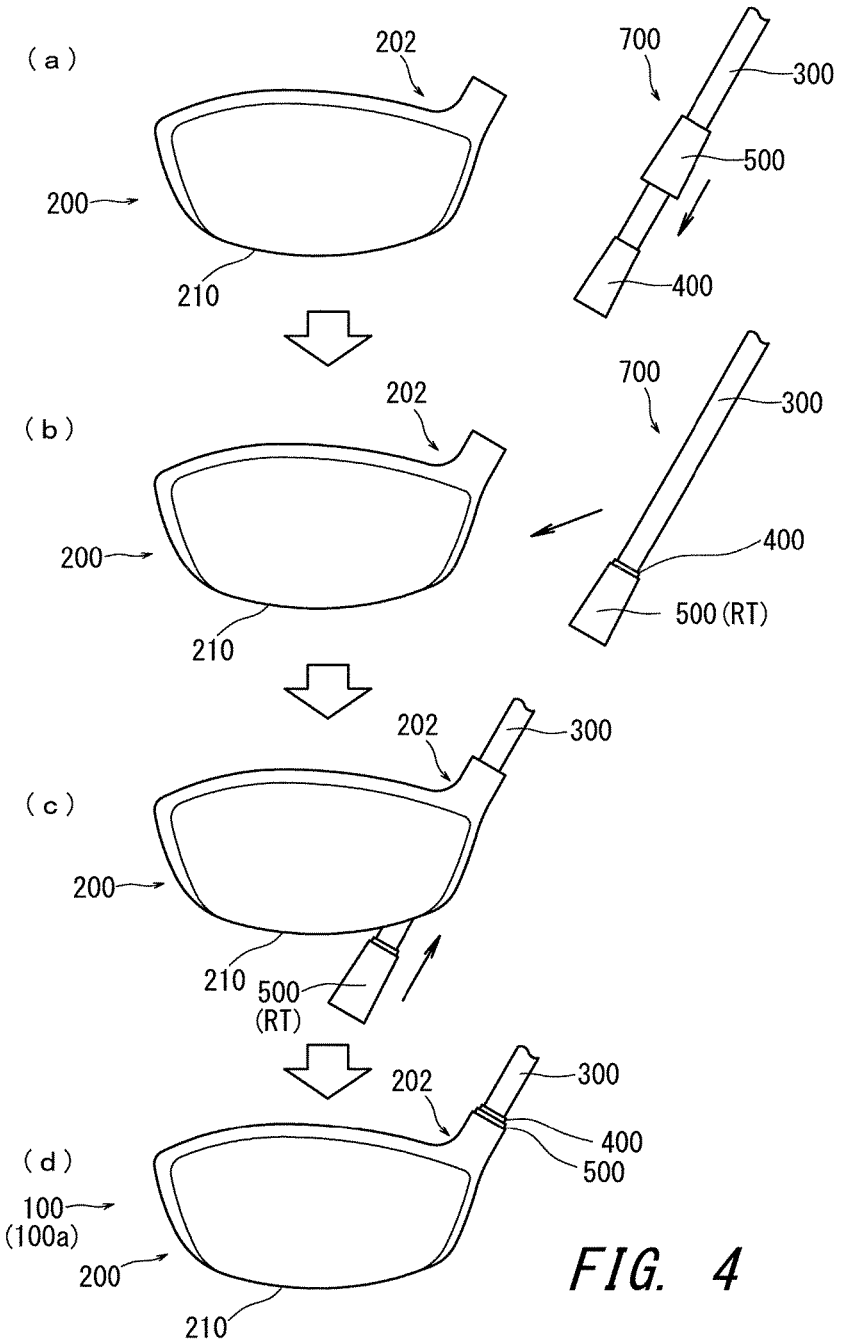
FIG. 4 is an assembling process view of the golf club in FIG. 1.

FIG. 4 shows a procedure of mounting the shaft 300 to the head 200 for the golf club 100.

In the mounting procedure, a shaft assembly 700 is first prepared (symbol (a) in FIG. 4; first step). The shaft assembly 700 has a shaft 300, a sleeve 400, and a spacer 500. After the shaft 300 is inserted into the spacer 500, the sleeve 400 is fixed to a tip portion of the shaft 300, to obtain the shaft assembly 700. In the shaft assembly 700, the sleeve 400 is fixed to the shaft 300, but the spacer 500 is not fixed to the shaft 300. The spacer 500 can move in the axial direction in a state where the shaft 300 is inserted into the spacer 500 (see symbol (a) in FIG. 4). However, the spacer 500 does not fall off from the shaft 300 under the presence of the sleeve 400.

As explained later, it is preferable that the spacer 500 can be mounted to the shaft 300 even after the sleeve 400 is fixed to the shaft 300.

Next, in the shaft assembly 700, the spacer 500 is moved until the spacer 500 abuts on an outer surface of the sleeve 400 (symbol (b) in FIG. 4; second step). That is, the spacer 500 is moved to the forefront side of the shaft assembly 700. By the movement, the spacer 500 is engaged with the sleeve 400 to complete a reverse-tapered engagement part RT.

Next, the shaft 300 is made to pass through the hosel slit 206, and the shaft 300 is moved to an inside of a reverse-tapered hole 205 (symbol (c) in FIG. 4; third step). As a result of the movement of the shaft 300, the reverse-tapered engagement part RT moves to the sole 210 side of the head 200.

Finally, the shaft 300 (shaft assembly 700) is moved to a grip side along the axial direction, and the reverse-tapered engagement part RT is fitted to the reverse-tapered hole 205 (symbol (d) in FIG. 4; fourth step). The mounting of the shaft 300 to the head 200 is achieved by the fitting. In other words, an engagement state is achieved by the fitting. The engagement state is a state where the golf club 100 can be used. In the engagement state, all reverse-tapered engagements are achieved. The all reverse-tapered engagements mean: a reverse-tapered engagement between the sleeve 400 and the spacer 500; and a reverse-tapered engagement between the spacer 500 and the reveres-tapered hole 205.

Thus, the shaft 300 (shaft assembly 700) is easily attached to the head 200. In addition, the shaft 300 (shaft assembly 700) is also easily detached from the head 200 by reversing the procedure of the above-mentioned second to fourth steps. In the golf club 100, the shaft 300 is detachably attached to the head 200.

Figures 5A, 5B, 5C:
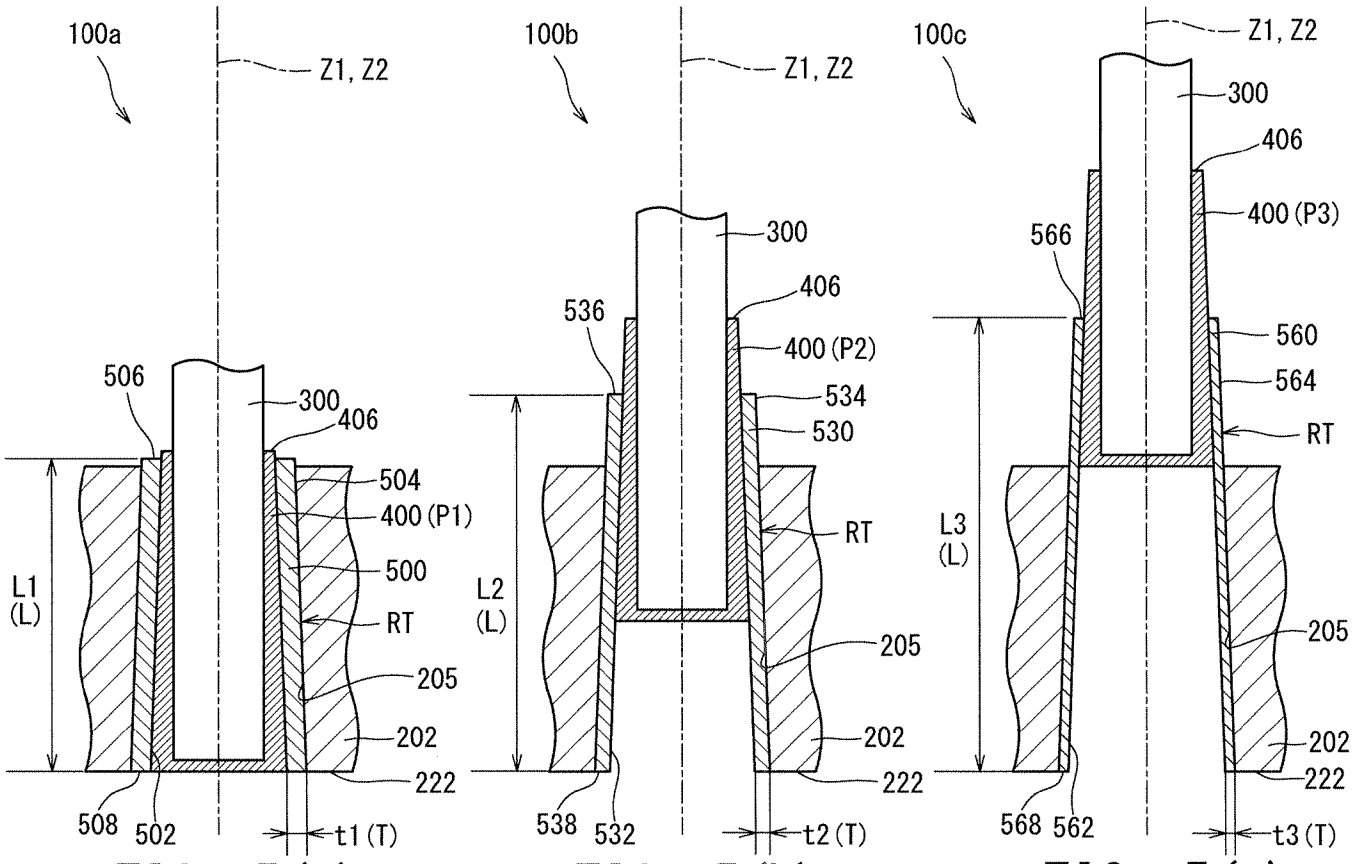
FIG. 5(*a*) to FIG. 5(*c*) are sectional views of the golf club according to the first embodiment, and show variations of club length.

FIG. 5(*a*) to FIG. 5(*c*) are sectional views of the golf club 100 taken along the axial direction. Hereinafter, among the spacers 500, 530, and 560, a case where the spacer 500 is used is defined as a golf club 100*a*. The golf club 100*a* is in a state where the club length is the minimum. In the golf club 100*a*, the reverse-tapered engagement part RT is constituted by the sleeve 400 and the spacer 500. Among the spacers 500, 530, and 560, a case where the spacer 530 is used is defined as a golf club 100*b*. The golf club 100*b* is in a state where the club length is medium. In the golf club 100*b*, the reverse-tapered engagement part RT is constituted by the sleeve 400 and the spacer 530. Among the spacers 500, 530, and 560, a case where the spacer 560 is used is defined as a golf club 100*c*. The golf club 100*c* is in a state where the club length is the maximum. In the golf club 100*c*, the reverse-tapered engagement part RT is constituted by the sleeve 400 and the spacer 560.

FIG. 5(*a*) is a sectional view of the golf club 100*a* taken along the axial direction. The golf club 100 shown in FIG. 1 and FIG. 2 is the golf club 100*a*. FIG. 5(*b*) is a sectional view of the golf club 100*b* taken along the axial direction. FIG. 5(*c*) is a sectional view of the golf club 100*c* taken along the axial direction.

As shown in FIG. 5(*a*) to FIG. 5(*c*), the spacers 500, 530 and 560 are varied in wall thickness T. A wall thickness t2 of the second spacer 530 is thinner than a wall thickness t1 of the first spacer 500. A wall thickness t3 of the third spacer 560 is thinner than the wall thickness t2 of the second spacer 530.

As shown in FIG. 5(*a*) to FIG. 5(*c*), the spacers 500, 530 and 560 are varied in length L. A length L2 of the second spacer 530 is greater than a length L1 of the first spacer 500. A length L3 of the third spacer 560 is greater than the length L2 of the second spacer 530. The thinner the spacer is, the longer the spacer is. That is, the smaller the wall thickness T of the spacer is, the greater the length L of the spacer is.

Because of the variations of the wall thicknesses T in the spacers, the spacers are varied in sectional area of the inner surface thereof. In a comparison of the spacers at a same axial-direction position, the thinner the wall thickness T of the spacer is, the greater the sectional area of the inner surface of the spacer is. Specifically, in the comparison of the spacers at the same axial-direction position, the sectional area of the inner surface 532 of the second spacer 530 is greater than the sectional area of the inner surface 502 of the first spacer 500. In the comparison of the spacers at the same axial-direction position, the sectional area of the inner surface 562 of the third spacer 560 is greater than the sectional area of the inner surface 532 of the second spacer 530.

Therefore, in the engagement state, the axial-direction positions of the sleeve 400 with respect to the respective spacers varies from each other. The axial-direction position of the sleeve 400 which is engaged with the first spacer 500 is defined as P1, the axial-direction position of the sleeve 400 which is engaged with the second spacer 530 is defined as P2, and the axial-direction position of the sleeve 400 which is engaged with the third spacer 560 is defined as P3. As shown in FIG. 5(*a*) to FIG. 5(*c*), the axial-direction position P2 is located on an upper side relative to the axial-direction position P1. The axial-direction position P3 is located on an upper side relative to the axial-direction position P2.

Because of the variations of the axial-direction positions, club length is varied. The golf club 100*b* is longer than the golf club 100*a*. The golf club 100*c* is longer than the golf club 100*b*.

Thus, in the golf club 100, the club length is varied by changing the wall thicknesses T of the spacers 500, 530 and 560.

In the golf club 100, lengths L of the spacers 500, 530 and 560 varies with the variations of the wall thicknesses T thereof. That is, the smaller the wall thickness T is, the greater the length L is. For this reason, although the axial-direction position of the sleeve 400 is shifted, the engaging area of the sleeve 400 with each of the spacers is maintained. The engaging area of each of the spacers with the reverse-tapered hole 205 is also maintained. Therefore, in all the golf club 100*a*, the golf club 100*b*, and the golf club 100*c*, the fixation of the shaft 300 to the head 200 is attained to such an extent that the fixation endures actual hits.

A contact area of the sleeve and the spacer in the engagement state is defined as S. In the embodiment of FIG. 5(*a*) to FIG. 5(*c*), the contact area S of the golf club 100*a* is defined as S1, the contact area S of the golf club 100*b* is defined as S2, and the contact area S of the golf club 100*c* is defined as S3. In the present embodiment, the formula S1>S2>S3 is satisfied.

Thus, the contact area S is determined for each of the different club lengths. Of the contact areas S, the maximum value is defined as Smax, and the minimum value is defined as Smin. In the present embodiment, the maximum value Smax is S1, and the minimum value Smin is S3. In light of ensuring the holding of the shaft 300, Smin/Smax is preferably equal to or greater than 0.5, more preferably equal to or greater than 0.6, still more preferably equal to or greater than 0.7, still more preferably equal to or greater than 0.8, and yet still more preferably equal to or greater than 0.9. It is also preferable that Smin/Smax is 1.

In light of ensuring the holding of the shaft 300, the contact area S is preferably equal to or greater than 120 $mm^2$, more preferably equal to or greater than 360 $mm^2$, and still more preferably equal to or greater than 600 $mm^2$. An excessively large hosel part 202 decreases the degree of freedom in design of the head 200. In this respect, the contact area S is preferably equal to or less than 3000 $mm^2$, more preferably equal to or less than 2400 $mm^2$, and still more preferably equal to or less than 1800 $mm^2$.

As shown in FIG. 5(*a*) to FIG. 5(*c*), the first spacer 500 has an upper end surface 506 and a lower end surface 508. The second spacer 530 has an upper end surface 536 and a lower end surface 538. The third spacer 560 has an upper end surface 566 and a lower end surface 568.

As shown in FIG. 5(*a*) to FIG. 5(*c*), in the golf clubs 100*a*, 100*b*, and 100*c*, the axial-direction positions of the lower end surfaces of respective spacers are the same. It is not limited to such a structure. In the engagement state, the lower end surface of a spacer may be located at an upper side as the wall thickness T of the spacer becomes thinner. That is, in the engagement state, the lower end surface 538 may be located on an upper side relative to the lower end surface 508. In the engagement state, the lower end surface 568 may be located on an upper side relative to the lower end surface 538.

As shown in FIG. 5(*a*), in the golf clubs 100*a*, 100*b*, and 100*c*, the upper end surfaces 506, 536, 566 of the respective spacers are located on a lower side relative to the upper end surface 406 of the sleeve 400. In this embodiment, a stairs-shaped exposed part is formed by the spacer and the sleeve. The stairs-shaped exposed part is preferable because an appearance like a ferrule is attained. Of course, it is not limited to such a structure. The axial-direction positions of the upper end surfaces 506, 536, 566 of the respective spacers may be the same as the axial-direction position of the upper end surface 406 of the sleeve 400. The upper end surfaces 506, 536, 566 of the respective spacers may be located on an upper side relative to the upper end surface 406 of the sleeve 400.

Figure 6:
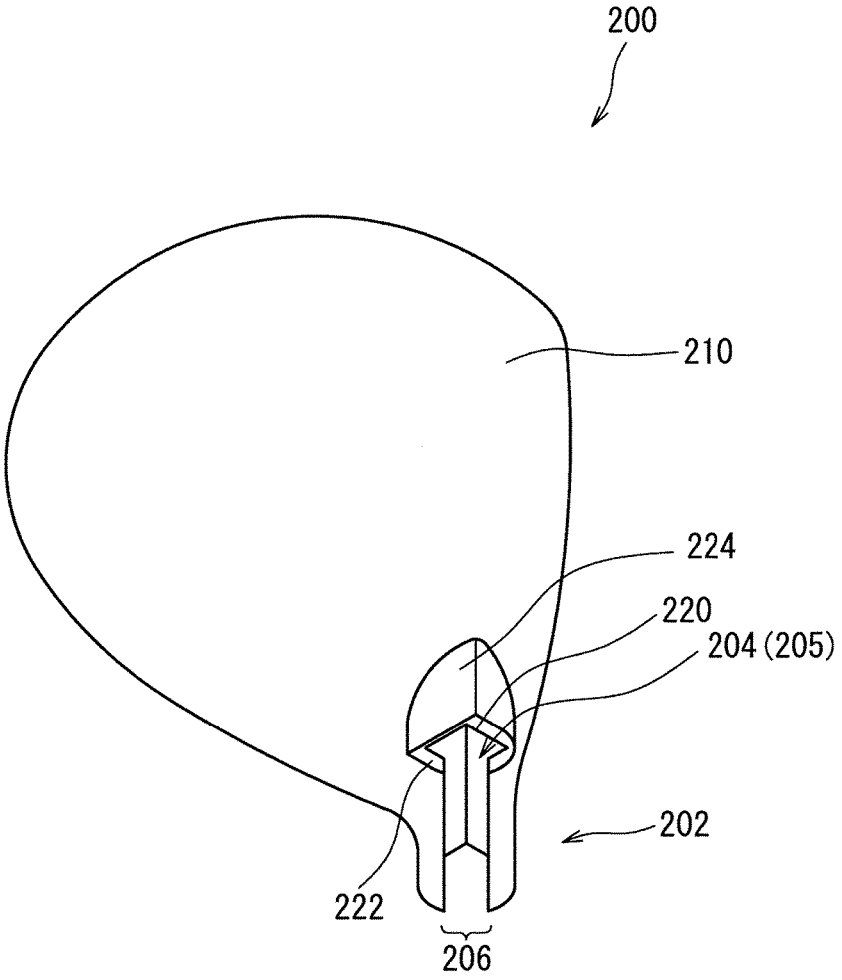
FIG. 6 is a perspective view of a head according to the first embodiment.

FIG. 6 is a perspective view of the head 200. The head 200 has a lower opening 220 located at a lower end of the reverse-tapered hole 205, an opening bottom surface 222 which extends in the axial orthogonal direction from the lower opening 220, and an extension surface 224 which extends toward the sole side from the opening bottom surface 222.

In the embodiment of FIG. 5(*a*) to FIG. 5(*c*), in the golf clubs 100*a*, 100*b*, 100*c*, the axial-direction positions of the lower end surfaces of the respective spacers are the same as the axial-direction position of the opening bottom surface 222. The present disclosure is not limited to such a structure. In the engagement state, the axial-direction positions of the lower end surfaces of the respective spacers may be located on an upper side relative to the opening bottom surface 222. In the engagement state, the axial-direction positions of the lower end surfaces of the respective spacers may be located on a lower side relative to the opening bottom surface 222.

Figure 7:
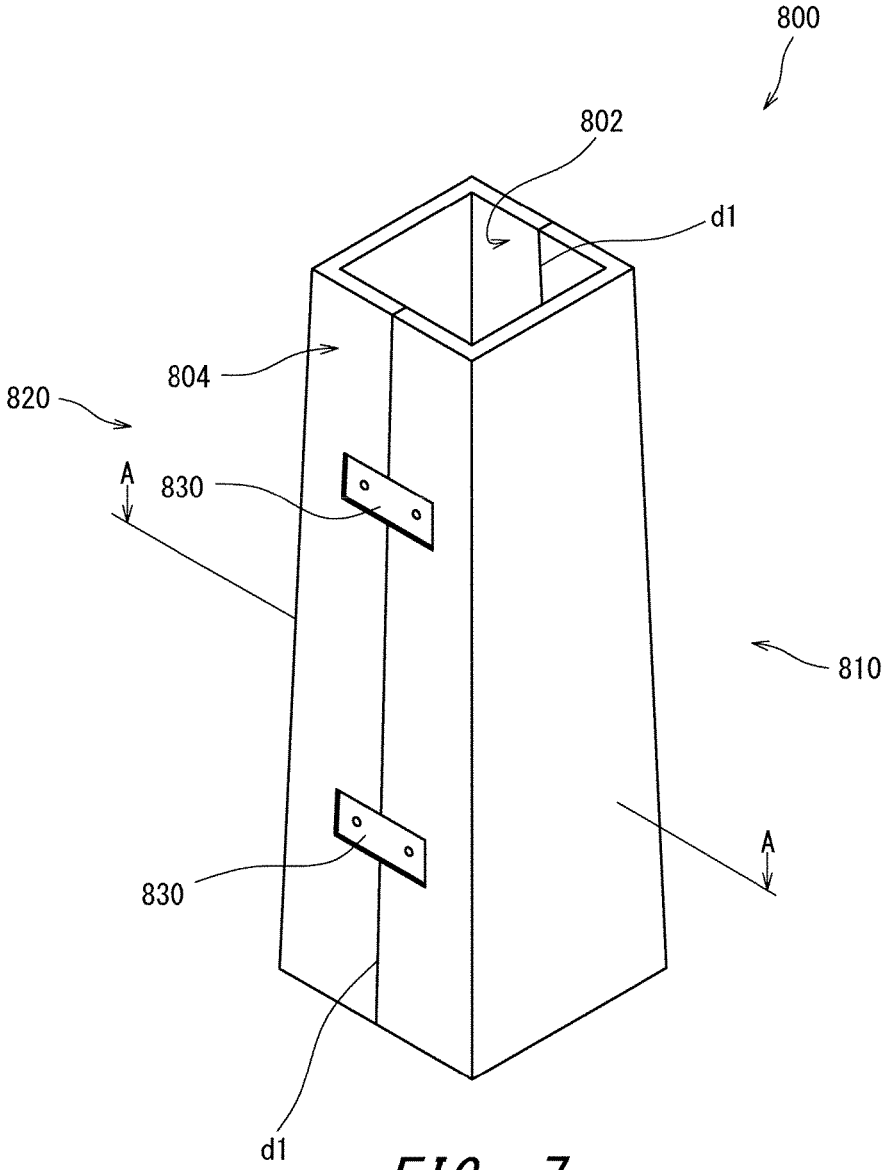
FIG. 7 is a perspective view of a spacer according to a modification example, FIG. 8(*a*) is a sectional view of the spacer in FIG. 7, FIG. 8(*b*) is a sectional view of a main part of a spacer according to another modification example, and FIG. 8(*c*) is a sectional view of a main part of a spacer according to another modification example.
Figure 8A:
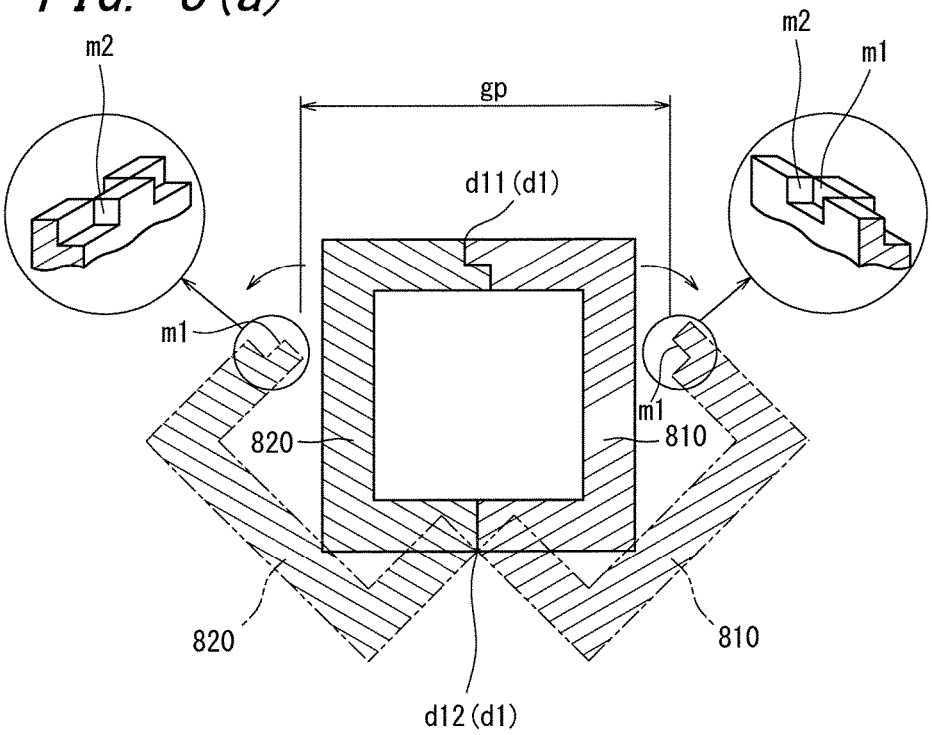
Figure 8B:
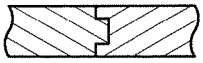
Figure 8C:
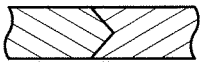

FIG. 7 is a perspective view of a spacer 800 of a modification example. FIG. 8(*a*) is a sectional view taken along line A-A in FIG. 7. The spacer 800 is an example of a spacer which can be replaced while the sleeve 400 remains fixed to the shaft 300. If the sleeve 400 is bonded to the shaft 300 by an adhesive, a spacer like the spacer 800, which can be replaced while the sleeve 400 remains fixed to the shaft 300, is preferably used.

As with the above-mentioned spacer 500 and the like, the spacer 800 has an inner surface 802 and an outer surface 804.

The spacer 800 has a divided structure. The spacer 800 has a first divided body 810 and a second divided body 820. A divisional line dl is shown in FIG. 7. The divisional line dl is a boundary between the first divided body 810 and the second divided body 820.

The spacer 800 has a connecting part 830. In the present embodiment, the connecting part 830 is a plate spring. The plate spring is an elastic body. In the present embodiment, two connecting parts 830 are provided. One sides of the connecting parts 830 are fixed to the first divided body 810, and the other sides of the connecting parts 830 is fixed to the second divided body 820.

The connecting parts 830 are housed in respective recessed parts provided on the outer surface 804. The connecting parts 830 are not projected outside the outer surface 804. The connecting parts 830 do not hamper contact between the outer surface 804 and a reverse-tapered surface to which the outer surface 804 is fitted. The reverse-tapered surface to which the outer surface 804 is fitted is the reverse-tapered hole of the head or an inner surface of another spacer.

The connecting parts 830 play the role of a hinge. The spacer 800 opens on the connecting parts 830. The spacer 800 opens by adding an external force. This opened state is shown by two-dot chain lines in FIG. 8(*a*). The spacer 800 opens by bending the connecting parts 830 (plate springs). In this opened state, a gap gp is produced between the first divided body 810 and the second divided body 820. A shaft can be put inside the spacer 800 through the gap gp. The spacer 800 is closed in a state where the shaft is put inside the spacer 800. The plate springs 830 bias the spacer 800 such that the spacer 800 is in a closed state. Therefore, the spacer 800 is (automatically) closed if the external force is lost.

The spacer 800 designed to open and close enables to replace the spacer. As shown in FIG. 4(*a*), in the shaft assembly 700, although the spacer 500 can move on the shaft 300 in the axial direction, the spacer 500 cannot be detached from the shaft 300 in the present state. This is because the sleeve 400 is undetachably fixed to the shaft 300. However, the spacer 800 can receive the shaft 300 from the side by adopting the above-mentioned opened state. Thus, the spacer 800 can be attached to/detached from the shaft 300 fixed to the sleeve 400. Therefore, the spacer can be replaced with another for the shaft 300 to which the sleeve 400 is fixed.

The spacer 800 has a position-adjusting structure to prevent a positional deviation between the first divided body 810 and the second divided body 820. As the position-adjusting structure, a structure of joining plates may be applied. The embodiment of FIG. 8(*a*) includes an example of the position-adjusting structure. In the position-adjusting structure, the first divided body 810 has an abutting surface m1 which prevents the positional deviation in a thickness direction, and an abutting surface m2 which prevents the positional deviation in the axial direction. Similarly, the second divided body 820 has an abutting surface m1 which prevents the positional deviation in the thickness direction, and an abutting surface m2 which prevents the positional deviation in the axial direction. In the spacer 800 in a closed state, the abutting surface m1 of the first divided body 810 abuts on the abutting surface m1 of the second divided body 820, and the abutting surface m2 of the first divided body 810 abuts on the abutting surface m2 of the second divided body 820. Therefore, the positional deviations in the thickness direction and the axial direction are prevented.

As shown in FIG. 8(*a*), the divisional line dl of the spacer 800 has a first divisional line d11 and a second divisional line d12. The first divisional line d11 is a divisional line not including the connecting part 830. The second divisional line d12 is a divisional line including the connecting part 830. FIG. 8(*a*) shows the above-mentioned position-adjusting structure provided on the first divisional line d11. Preferably, the position-adjusting structure is provided also on the second divisional line d12.

FIG. 8(*b*) shows another position-adjusting structure. In this position-adjusting structure, a projection of a first member and a recess of a second member are butted against each other. A center portion in a thickness direction of the first member is overlapped with an inner side and an outer side in a thickness direction of the second member. The first member is either one of the first divided body 810 and the second divided body 820, and the second member is the other of the first divided body 810 and the second divided body 820.

FIG. 8(*c*) shows another position-adjusting structure. In this position-adjusting structure, a projection of a first member and a recess of a second member are butted against each other. The section of the projection of the first member is constituted by slopes. The section of the recess of the second member is constituted by slopes. A center portion in a thickness direction of the first member is overlapped with an inner side and an outer side in a thickness direction of the second member. The first member is either one of the first divided body 810 and the second divided body 820, and the second member is the other of the first divided body 810 and the second divided body 820.

Such position-adjusting structures shown in FIG. 8(*b*) and FIG. 8(*c*) can also prevent the positional deviation in the axial direction in addition to the positional deviation in the thickness direction. For example, when such a position-adjusting structure as shown in FIG. 8(*b*) or FIG. 8(*c*) is adopted only at a part of the axial direction, an abutting surface capable of preventing the positional deviation in the axial direction can be formed at a termination position of the position-adjusting structure. Therefore, the positional deviation in the axial direction can be prevented.

Figure 9:
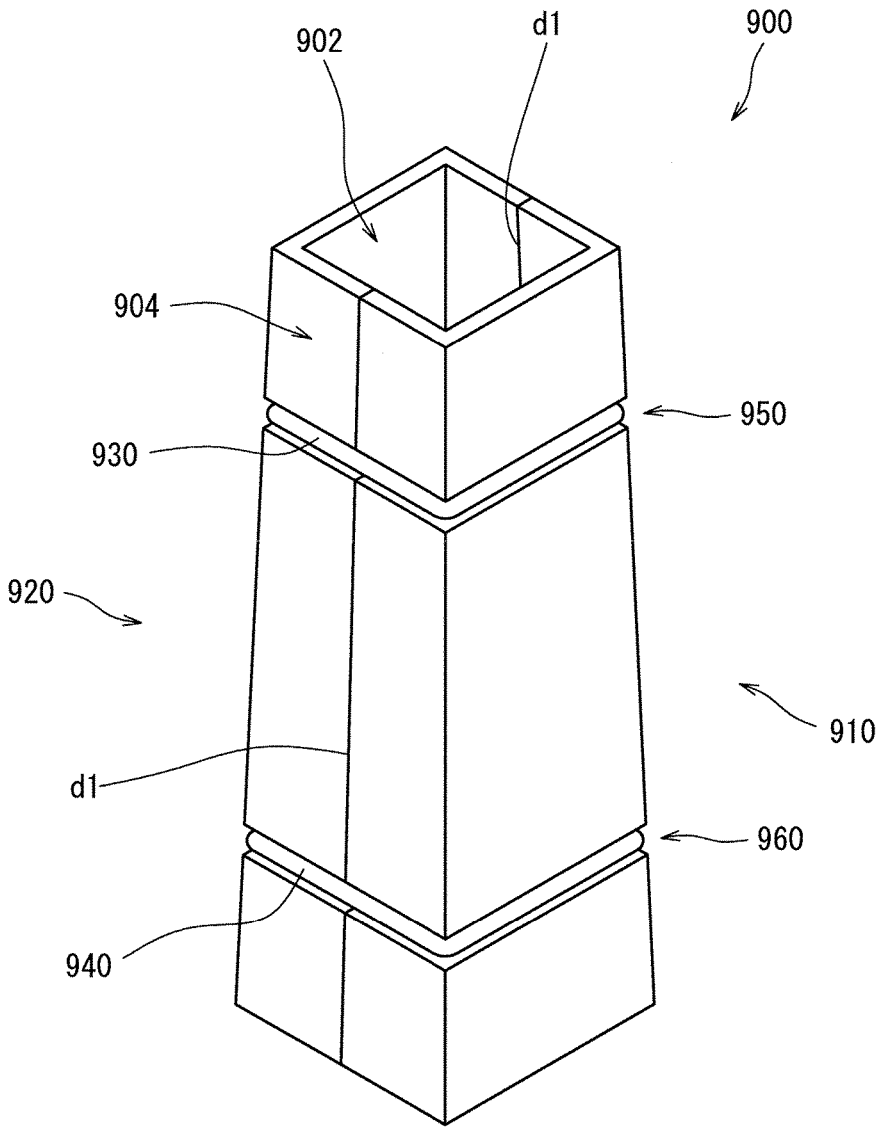
FIG. 9 is a perspective view of a spacer according to another modification example.

FIG. 9 is a perspective view of a spacer 900 according to another modification example. As with the above-mentioned spacer 500 and the like, the spacer 900 has an inner surface 902 and an outer surface 904.

As with the spacer 800, the spacer 900 has a divided structure. The spacer 900 has a first divided body 910 and a second divided body 920. A divisional line dl is shown in FIG. 9. The divisional line dl is a boundary between the first divided body 910 and the second divided body 920.

The spacer 900 has ring-shaped elastic bodies 930 and 940. The spacer 900 further has circumferential grooves 950 and 960. The elastic bodies 930 and 940 are fitted to the circumferential grooves 950 and 960, respectively. The elastic bodies 930 and 940 are not projected outside the outer surface 904. The elastic bodies 930 and 940 do not hamper contact between the outer surface 904 and a reverse-tapered surface to which the outer surface 904 is fitted. The reverse-tapered surface to which the outer surface 904 is fitted is the reverse-tapered hole of the head or an inner surface of another spacer.

The elastic bodies 930 and 940 can be removed by stretching the elastic bodies 930 and 940 with external force. The first divided body 910 and the second divided body 920 can be separated from each other by removing the elastic bodies 930 and 940. On the contrary, the elastic bodies 930 and 940 can be attached after butting the first divided body 910 and the second divided body 920 against each other. The elastically contractile force of the elastic bodies 930 and 940 biases the divided bodies 910 and 920 such that the two divided bodies 910 and 920 are butted against each other. For example, this spacer 900 also enables to replace a spacer.

The spacer 800 and the spacer 900 each have the first divided body and the second divided body. A mutual shifting between a connected state in which the first divided body and the second divided body are connected to each other, and a separated state in which a gap is formed between the first divided body and the second divided body is enabled. In the separated state, the shaft can be disposed inside the spacer by allowing the shaft to pass through the gap. In the separated state, the spacer can be attached to or detached from the shaft 300 to which the sleeve 400 has been fixed.

Figures 10A, 10B, 10C:
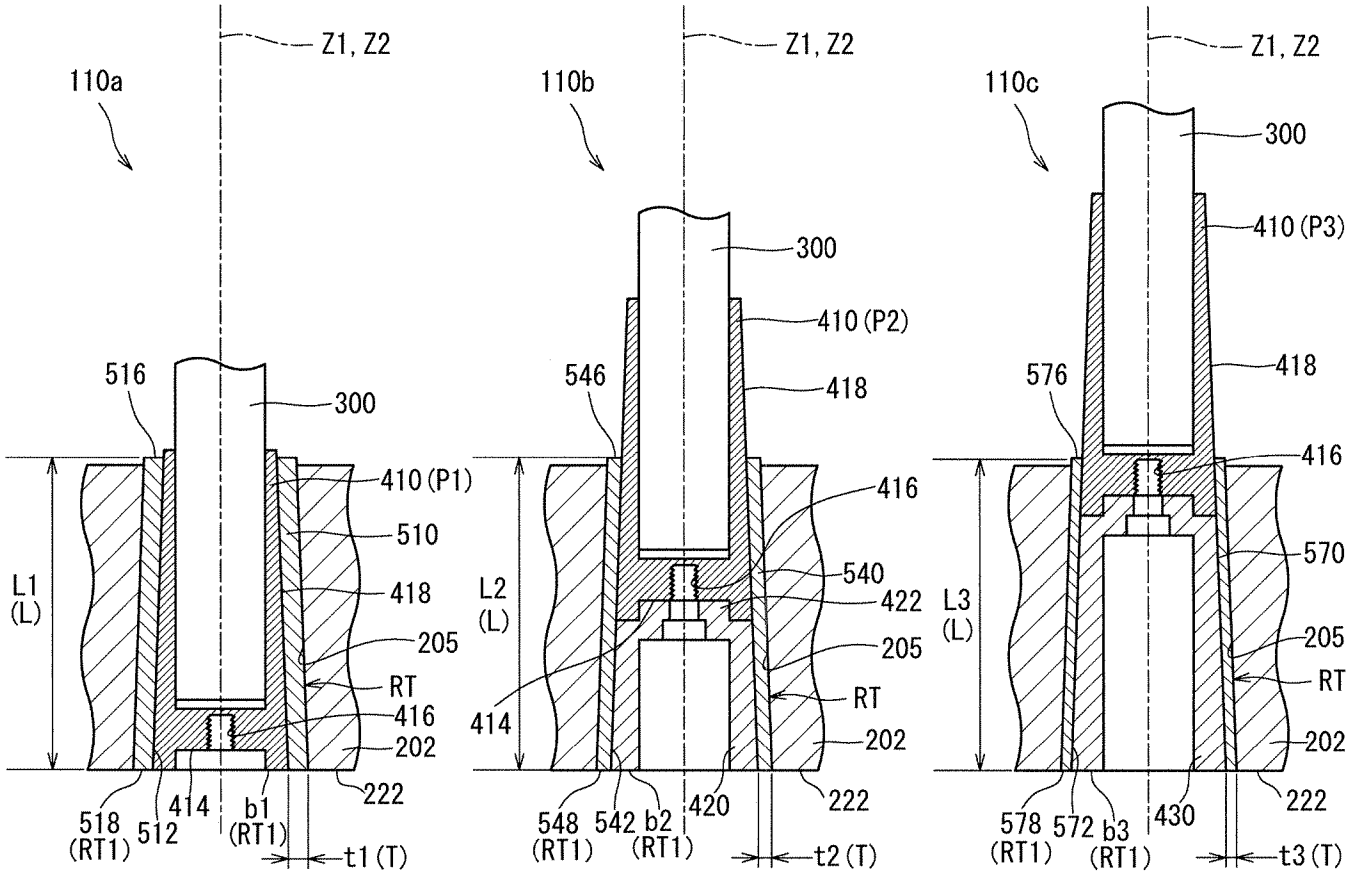
FIG. 10(*a*) to FIG. 10(*c*) are sectional views of a golf club according to a second embodiment, and show variations of club length.
Figure 11:
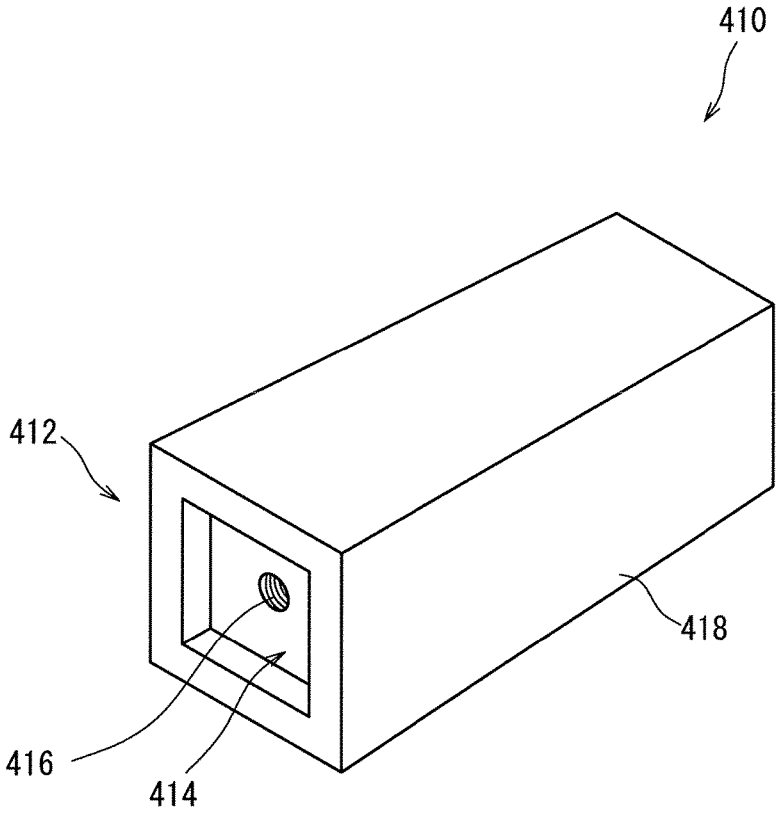
FIG. 11 is a perspective view of a sleeve used for the golf club of the second embodiment.
Figure 12:
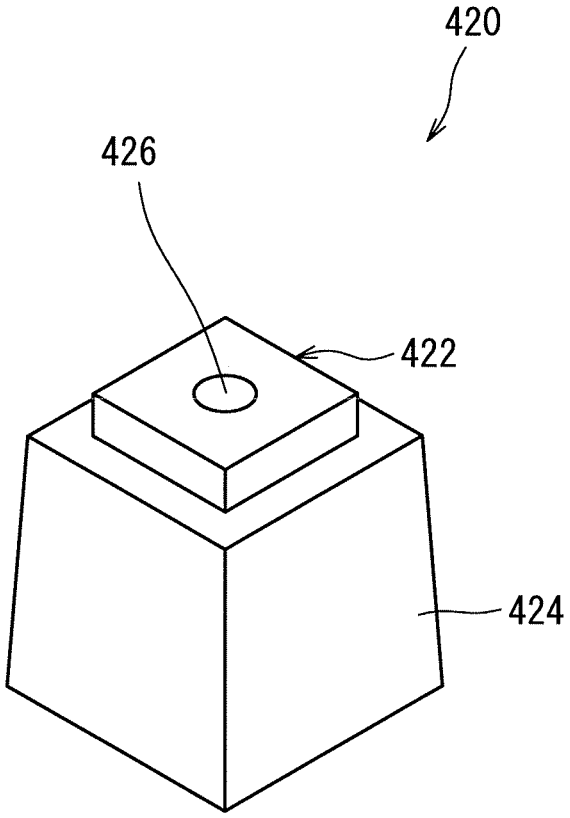
FIG. 12 is a perspective view of an extension sleeve to be connected to the sleeve of FIG. 11.
Figure 13A:
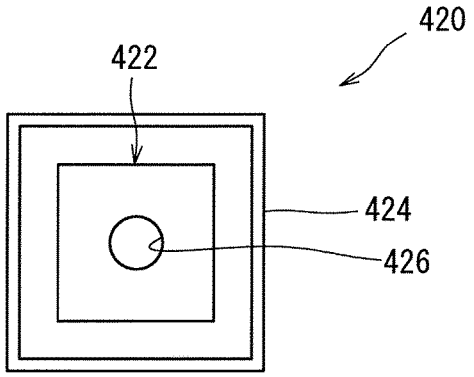
FIG. 13(*a*) is a plan view of the extension sleeve in FIG. 12, FIG. 13(*b*) is a side view thereof, and FIG. 13(*c*) is a bottom view thereof.
Figure 13B:
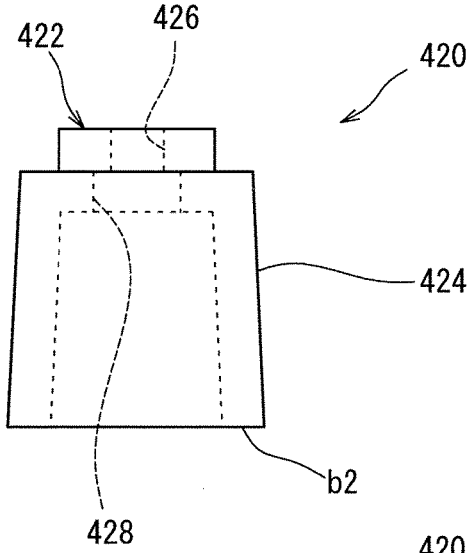
Figure 13C:
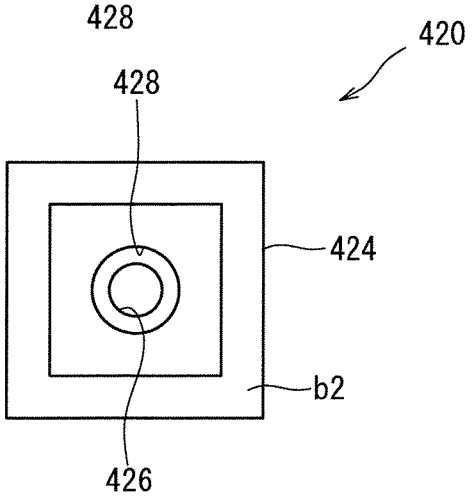

FIG. 10(*a*) to FIG. 10(*c*) are sectional views of a golf club 110 according to a second embodiment. FIG. 11 is a perspective view of a sleeve 410 used for the golf club 110. FIG. 12 is a perspective view of an extension sleeve 420 used for the golf club 110. FIG. 13(*a*) is a plan view of the extension sleeve 420, FIG. 13(*b*) is a side view of the extension sleeve 420, and FIG. 13(*c*) is a bottom view of the extension sleeve 420.

The golf club 110 in the engagement state has one spacer and one sleeve. A golf club kit according to the golf club 110 has a plurality of (three) spacers. Any one of the three spacers is used. The other two are spacers for replacement.

Hereinafter, among the plurality of spacers 510, 540 and 570, a case where the spacer 510 is used is defined as a golf club 110*a*. The golf club 110*a* is in a state where the club length is the minimum. Among the plurality of spacers 510, 540 and 570, a case where the spacer 540 is used is defined as a golf club 110*b*. The golf club 110*b* is in a state where the club length is medium. Among the plurality of spacers 510, 540 and 570, a case where the spacer 570 is used is defined as a golf club 110*c*. The golf club 110*c* is in a state where the club length is the maximum.

FIG. 10(*a*) is a sectional view of the golf club 110*a* taken along the axial direction. FIG. 10(*b*) is a sectional view of the golf club 110*b* taken along the axial direction. FIG. 10(*c*) is a sectional view of the golf club 110*c* taken along the axial direction.

As shown in FIG. 10(*a*) to FIG. 10(*c*), the spacers 510, 540 and 570 are varied in wall thickness T. A wall thickness t2 of the second spacer 540 is thinner than a wall thickness t1 of the first spacer 510. A wall thickness t3 of the third spacer 570 is thinner than the wall thickness t2 of the second spacer 540.

As shown in FIG. 10(*a*) to FIG. 10(*c*), the spacers 510, 540 and 570 are not varied in length L. The golf club 110 is different in this point from the above-described golf club 100 according to the first embodiment. A length L2 of the second spacer 540 is the same as a length L1 of the first spacer 510. A length L3 of the third spacer 570 is the same as the length L2 of the second spacer 540. The spacers have a same length regardless of wall thicknesses thereof. The spacers have a same external shape regardless of wall thicknesses thereof.

Because of the variations of the wall thicknesses T in the spacers, the spacers are varied in sectional area of an inner surface thereof. In a comparison of the spacers at a same axial-direction position, the thinner the wall thickness T of the spacer is, the greater the sectional area of the inner surface of the spacer is. Specifically, in the comparison of the spacers at the same axial-direction position, a sectional area of an inner surface 542 of the second spacer 540 is greater than a sectional area of an inner surface 512 of the first spacer 510. In the comparison of the spacers at the same axial-direction position, a sectional area of an inner surface 572 of the third spacer 570 is greater than the sectional area of the inner surface 542 of the second spacer 540.

Therefore, in the engagement state, the axial-direction positions of the sleeve 410 with respect to the respective spacers varies from each other. The axial-direction position of the sleeve 410 which is engaged with the first spacer 510 is defined as P1, the axial-direction position of the sleeve 410 which is engaged with the second spacer 540 is defined as P2, and the axial-direction position of the sleeve 410 which is engaged with the third spacer 570 is defined as P3. As shown in FIG. 10(*a*) to FIG. 10(*c*), the axial-direction position P2 is located on an upper side relative to the axial-direction position P1. The axial-direction position P3 is located on an upper side relative to the axial-direction position P2.

Because of the variations of the axial-direction positions, club length is varied. The golf club 110*b* is longer than the golf club 110*a*. The golf club 110*c* is longer than the golf club 110*b*.

Thus, in the golf club 110, the club length is changed by changing wall thicknesses T of the spacers 510, 540 and 570.

In the golf club 110, lengths L of the spacers 510, 540 and 570 are not varied with the wall thicknesses T thereof. Lengths L of the spacers 510, 540 and 570 are the same regardless of wall thicknesses T thereof.

The golf club kit according to the golf club 110 has two extension sleeves 420 and 430. That is, the golf club kit according to the golf club 110 has the two extension sleeves 420 and 430 in addition to the three spacers 510, 540 and 570. Any one of the extension sleeves is used as necessary.

As shown in FIG. 10(*b*), the first extension sleeve 420 is used for the golf club 110*b* (club length: medium). The extension sleeve 420 is used together with the second spacer 540. The extension sleeve 420, together with the sleeve 410, is fitted inside of the spacer 540. As a result, in the golf club 110*b*, the reverse-tapered engagement part is constituted by the sleeve 410, the extension sleeve 420, and the spacer 540.

As shown in FIG. 10(*c*), the second extension sleeve 430 is used for the golf club 110*c* (club length: maximum). The extension sleeve 430 is longer than the extension sleeve 420. The extension sleeve 430 is used together with the third spacer 570. The extension sleeve 430, together with the sleeve 410, is fitted inside of the spacer 570. As a result, in the golf club 110*c*, the reverse-tapered engagement part is constituted by the sleeve 410, the extension sleeve 430, and the spacer 570.

Thus, the first extension sleeve 420 and the second extension sleeve 430 are used in the golf club 110. As shown in FIG. 10(*a*), the extension sleeves are not used in the state where the club length is the minimum (golf club 110*a*).

After all, in the golf club 110, three sorts of spacers and two sorts of extension sleeves are used. The golf club kit according to the golf club 110 has the plurality (three sorts) of spacers and the plurality (two sorts) of extension sleeves.

In the golf club kit, the total number of the spacers is defined as N2, and the number of the extension sleeves is defined as N4. Preferably, N2−N4=1. N2 and N4 are positive integers. Preferable range for the total number N2 is as mentioned above. N4 is preferably a value smaller than N2 by one. N4 is preferably equal to or greater than 1 and equal to or less than 3, and more preferably equal to or greater than 1 and equal to or less than 2.

As shown in FIG. 11, the sleeve 410 has a bottom part 412. The bottom part 412 has an engaging recessed part 414 and a screw hole 416. The engaging recessed part 414 is provided at a center of the bottom part 412. The engaging recessed part 414 has a sectional shape of a non-circle (a tetragon, a square). The screw hole 416 is provided at a center of the engaging recessed part 414. The sleeve 410 further has a side surface 418. The side surface 418 is a pyramid surface (four-sided pyramid surface).

As shown in FIG. 12 and FIG. 13(*a*) to FIG. 13(*c*), the extension sleeve 420 has an engaging projection part 422 and a side surface 424. The engaging projection part 422 is provided on an upper surface of the extension sleeve 420. The engaging projection part 422 is upwardly projected. The engaging projection part 422 has a sectional shape of a non-circle (a tetragon, a square). A through hole 426 is provided at a center of the engaging projection part 422.

As shown in FIG. 13(*b*), the inside of the extension sleeve 420 is hollow. The hollow is downwardly opened. A screw-housing hole 428 is provided on an upper part of an inner surface of the extension sleeve 420. The screw-housing hole 428 is disposed so as to be continuous with the through hole 426. The through hole 426 and the screw-housing hole 428 are coaxially disposed. As shown in FIG. 13(*c*), an inner diameter of the screw-housing hole 428 is larger than an inner diameter of the through hole 426. A head part of a screw (not shown in the drawing) is housed in the screw-housing hole 428.

As shown in FIG. 10(*b*), the extension sleeve 420 is connected to the lower side of the sleeve 410. In the connected state, the engaging projection part 422 is engaged with the engaging recessed part 414. The engaging projection part 422 is fitted to the engaging recessed part 414.

Although not shown in the drawings, the extension sleeve 420 is fixed to the sleeve 410 by a connection mechanism. In the present embodiment, the connection mechanism is a screw mechanism. The screw, which is not shown in the drawings, is inserted into the extension sleeve 420 from the lower side thereof, penetrates through the screw-housing hole 428 and the through hole 426, and is screwed to the screw hole 416. By the screwing, the extension sleeve 420 is fixed to the sleeve 410 to complete a connected state.

As described above, in the connected state, the engaging projection part 422 is fitted to the engaging recessed part 414. The engaging projection part 422 has an external shape corresponding to a shape of the engaging recessed part 414. In the connected state in which the engaging projection part 422 is fitted to the engaging recessed part 414, the extension sleeve 420 is positioned with respect to the sleeve 410. Because of the engagement of the engaging projection part 422 and the engaging recessed part 414, the extension sleeve 420 cannot be rotated with respect to the sleeve 410 in the connected state.

In the connected state, the side surface 418 of the sleeve 410 is flush with the side surface 424 of the extension sleeve 420. That is, surfaces of the side surface 418 are flush with respective surfaces of the side surface 424. As a result, a connected sleeve, an outer surface of which is a reverse-tapered surface (pyramid surface), is formed by the connected state in which the sleeve 410 is connected to the extension sleeve 420. The connected sleeve is fitted inside of the spacer 540 (FIG. 10(*b*)). In this case, the outer surface of the spacer 540 is the outer surface of the reverse-tapered engagement part RT.

As described above, the extension sleeve 430 is used for the golf club 110*c* in which club length is the maximum. Except for the difference in length, the extension sleeve 430 has the same shape as the shape of the extension sleeve 420. In accordance with the fact that the position P3 of the sleeve 410 is located above relative to the position P2, the extension sleeve 430 is made longer than the extension sleeve 420. A connection mechanism of the extension sleeve 430 to the sleeve 410 is the same as that of the extension sleeve 420 (see FIG. 10(*c*)).

In the golf club 110*a* in the engagement state, a lower end surface b1 of the sleeve 410 is exposed to the outside (see FIG. 10(*a*)). In the golf club 110*b* in the engagement state, a lower end surface b2 of the extension sleeve 420 is exposed to the outside (see FIG. 10(*b*)). In the golf club 110*c* in the engagement state, a lower end surface b3 of the extension sleeve 430 is exposed to the outside (see FIG. 10(*c*)). In the engagement state, the axial-direction position of the lower end surface b1 is the same as the axial-direction position of the lower end surface b2. In the engagement state, the axial-direction position of the lower end surface b2 is the same as the axial-direction position of the lower end surface b3.

In the golf club 110*b*, the sleeve 410 is upwardly shifted as compared with the golf club 110*a*. Because of the shift, in the golf club 110*b*, a contact area of the sleeve 410 and the spacer 540 becomes small. However, the connected sleeve in which the extension sleeve 420 is connected to the sleeve 410 is formed in the golf club 110*b*. Considering the whole connected sleeve, the contact area with the spacer 540 is secured. As a result, the sleeve 410 is securely held also in the golf club 110*b*.

In the golf club 110*c*, the sleeve 410 is upwardly shifted as compared with the golf club 110*b*. Because of the shift, a contact area of the sleeve 410 and the spacer 570 is further decreased in the golf club 110*c*. However, in the golf club 110*c*, the connected sleeve in which the extension sleeve 430 is connected to the sleeve 410 is formed. Considering the whole connected sleeve, the contact area with the spacer 570 is secured. As a result, the sleeve 410 is securely held also in the golf club 110*c*.

A contact area of the connected sleeve (the sleeve in the golf club 110*a*) and the spacer is defined as S. The contact area S is an area in the engagement state. If a connected sleeve is formed as in the golf club 110*b* and the golf club 110*c*, the contact area S is defined as a contact area of the connected sleeve and the spacer. In the embodiment of FIG. 10(*a*) to FIG. 10(*c*), the contact area S of the golf club 110*a* is defined as S1, the contact area S of the golf club 110*b* is defined as S2, and the contact area S of the golf club 110*c* is defined as S3. In the present embodiment, the formula S1=S2=S3 is satisfied.

In the golf club 110, the spacers 510, 540 and 570 have the same Length L. The spacers 510, 540 and 570 are varied from each other only in wall thickness T. Therefore, two or more sorts of spacers can be relatively easily designed and manufactured.

As shown in FIG. 10(*a*) to FIG. 10(*c*), the first spacer 510 has an upper end surface 516 and a lower end surface 518. The second spacer 540 has an upper end surface 546 and a lower end surface 548. The third spacer 570 has an upper end surface 576 and a lower end surface 578.

As shown in FIG. 10(*a*) to FIG. 10(*c*), in the golf clubs 110*a*, 110*b*, and 110*c*, the axial-direction positions of the lower end surfaces 518, 548 and 578 of the respective spacers are the same. In the golf clubs 110*a*, 110*b* and 110*c*, the axial-direction positions of the lower end surfaces b1, b2, and b3 are the same. The axial-direction positions of the lower end surfaces 518, 548 and 578 of the respective spacers coincide with the respective axial-direction positions of the lower end surfaces b1, b2, and b3. In the golf club 110, the axial-direction position of a lower end surface RT1 of the reverse-tapered engagement part RT is the same regardless of club length.

Figure 14A:
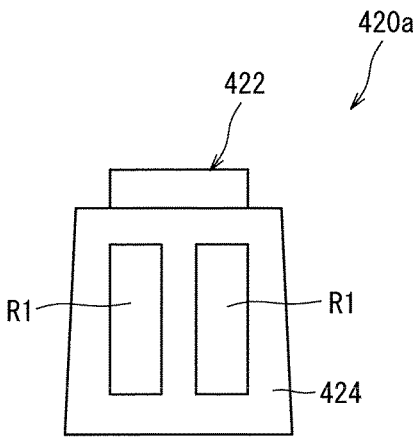
FIG. 14(*a*) is a side view of an extension sleeve according to a modification example, and FIG. 14(*b*) is a side view of an extension sleeve according to another modification example.
Figure 14B:
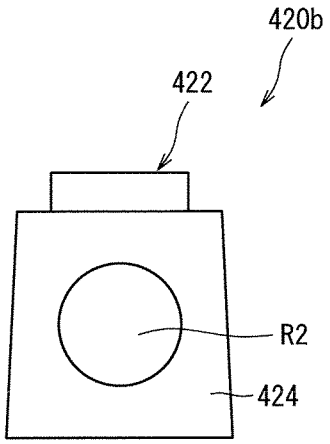

FIG. 14(*a*) is a side view of an extension sleeve 420*a* which is a modification example of the extension sleeve 420. FIG. 14(*b*) is a side view of an extension sleeve 420*b* which is another modification example of the extension sleeve 420.

As with the extension sleeve 420, the extension sleeve 420*a* has an engaging projection part 422 and a side surface 424. The engaging projection part 422 is provided in the upper surface of the extension sleeve 420*a*. The engaging projection part 422 is upwardly projected. The sectional shape of the engaging projection part 422 is a non-circle (a tetragon, a square). As shown in FIG. 14(*a*), a recessed part R1 is provided on the side surface 424. In a planar view, the recessed part R1 has a shape of a tetragon. Two recessed parts R1 are provided per side surface 424. Except for the presence of the recessed parts R1, the extension sleeve 420*a* is the same as the extension sleeve 420.

As with the extension sleeve 420, the extension sleeve 420*b* has an engaging projection part 422 and a side surface 424. The engaging projection part 422 is provided on the upper surface of the extension sleeve 420*b*. The engaging projection part 422 is upwardly projected. The sectional shape of the engaging projection part 422 is a non-circle (a tetragon, a square). As shown in FIG. 14(*b*), a recessed part R2 is provided on the side surface 424. In a planar view, the recessed part R2 has a shape of a circle. One recessed part R2 is provided per side surface 424. Except for the presence of the recessed part R2, the extension sleeve 420*b* is the same as the extension sleeve 420.

The recessed part R1 and the recessed part R2 contribute to mass reduction of the extension sleeve. The degree of freedom of design of the head is enhanced by the mass reduction of the extension sleeve.

The recessed part R1 and the recessed part R2 are examples of a mass reduction part to be provided on the extension sleeve. Another example of the mass reduction part includes a through hole which penetrates the side surface of the extension sleeve.

Such a mass reduction part can be provided also on the sleeve and the spacer.

Figure 15:
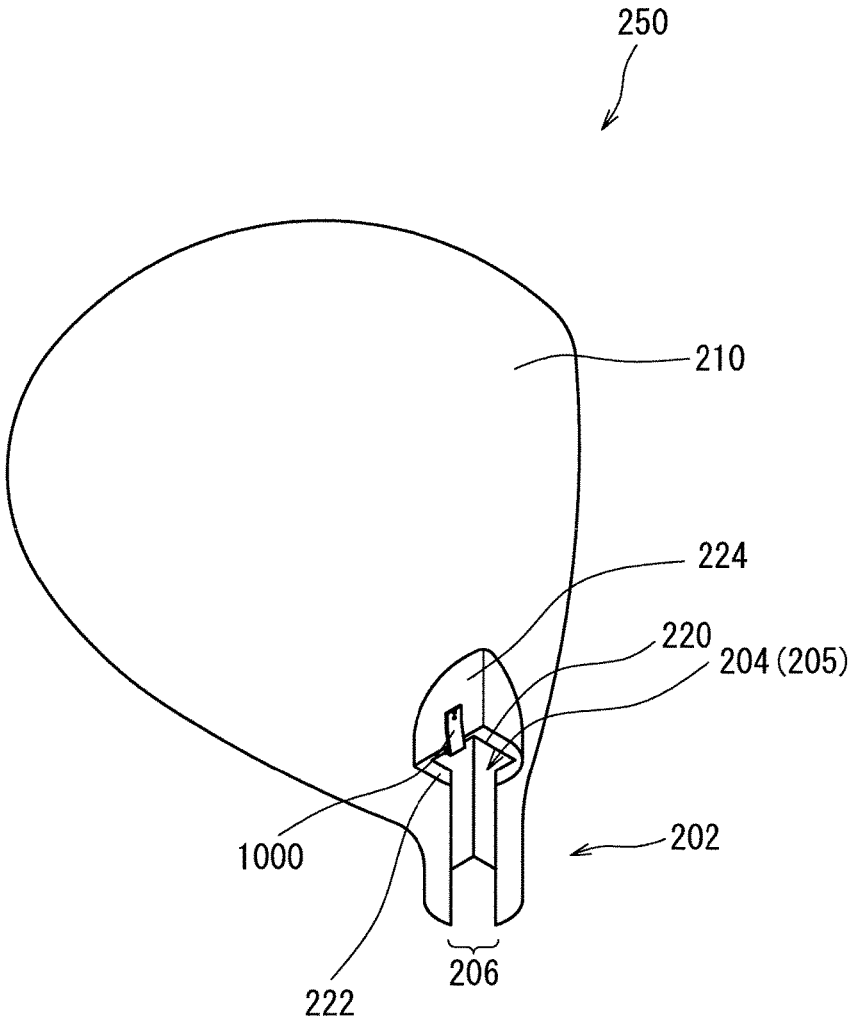
FIG. 15 is a perspective view of a head used for the golf club of the second embodiment.

FIG. 15 is a perspective view of a head 250 according to the second embodiment. The head 250 is the same as the head 200 except for the presence of a falling-off prevention mechanism to be described below.

The head 250 has a lower opening 220 located at the lower end of the reverse-tapered hole 205, an opening bottom surface 222 which extends in the axial orthogonal direction from the lower opening 220, and an extension surface 224 which extends toward the sole side from the opening bottom surface 222.

The head 250 has a falling-off prevention mechanism 1000. The falling-off prevention mechanism 1000 is provided on the extension surface 224. The falling-off prevention mechanism 1000 regulates the moving of the reverse-tapered engagement part (the sleeve and the spacer) in an engagement releasing direction.

Figure 16:
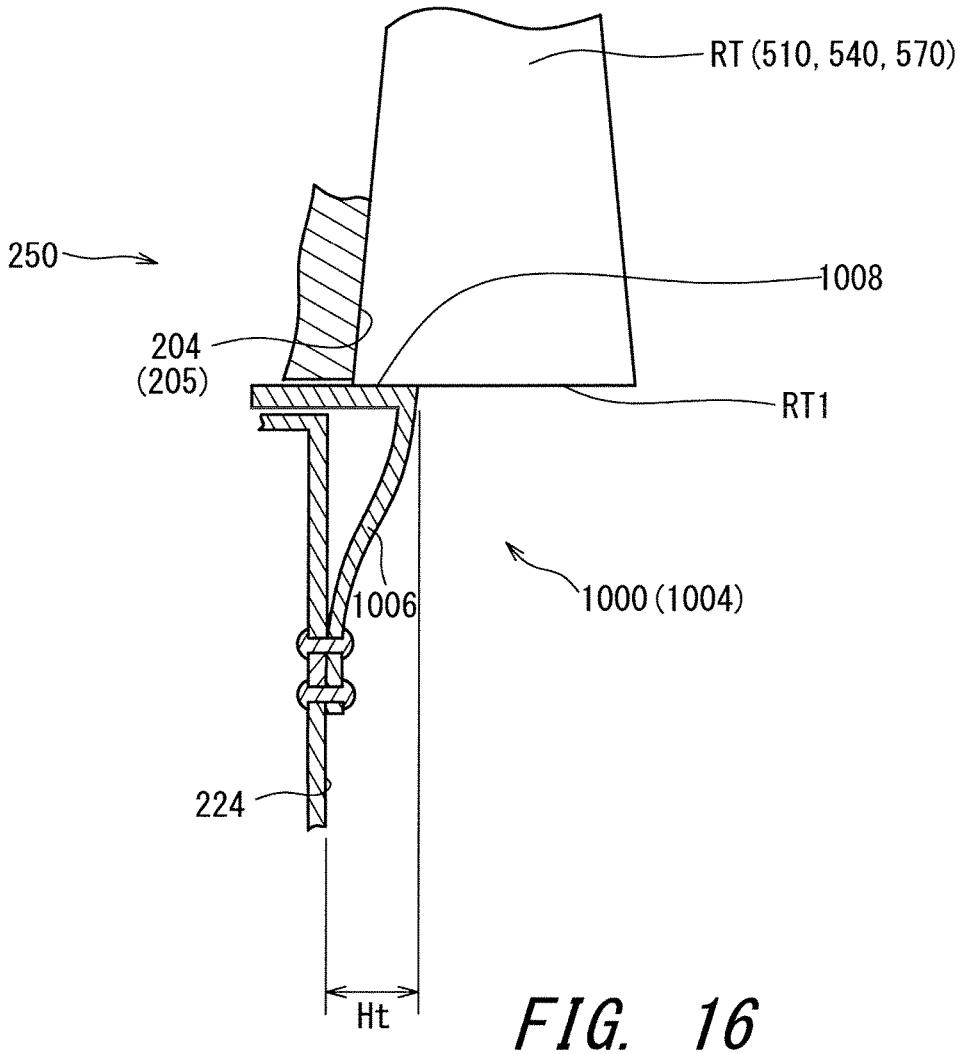
FIG. 16 is a sectional view of a falling-off prevention mechanism in the golf club of the second embodiment.

FIG. 16 is a sectional view of a vicinity of the falling-off prevention mechanism 1000. FIG. 16 is turned upside down relative to FIG. 15.

The falling-off prevention mechanism 1000 has an elastic projection 1004 biased in a projecting direction under a condition where the elastic projection 1004 can project and recede. In the present embodiment, the elastic projection 1004 is a plate spring 1006. FIG. 16 is a sectional view of the falling-off prevention mechanism 1000 in a natural state where an external force does not act thereon. In the natural state, the plate spring 1006 is configured such that a projection height Ht of the plate spring 1006 from the extension surface 224 is increased toward the reverse-tapered hole 205. In the natural state, the falling-off prevention mechanism 1000 has an abutting surface 1008 which abuts on the end face (lower end surface) of the reverse-tapered engagement part fitted to the reverse-tapered hole 205.

In the golf club 110*a* (see FIG. 10(*a*)), the abutting surface 1008 of the falling-off prevention mechanism 1000 abuts on the lower end surface 518 of the spacer 510, and the lower end surface b1 of the sleeve 410. In the golf club 110*a*, the lower end surface RT1 of the reverse-tapered engagement part RT is constituted by the lower end surface 518 and the lower end surface b1. The abutting surface 1008 abuts on the lower end surface RT1 (the lower end surface 518 and the lower end surface b1).

In the golf club 110*b* (see FIG. 10(*b*)), the abutting surface 1008 of the falling-off prevention mechanism 1000 abuts on the lower end surface 548 of the spacer 540, and the lower end surface b2 of the extension sleeve 420. In the golf club 110*b*, the lower end surface RT1 of the reverse-tapered engagement part RT is constituted by the lower end surface 548 and the lower end surface b2. The abutting surface 1008 abuts on the lower end surface RT1 (the lower end surface 548 and the lower end surface b2).

In the golf club 110*c* (see FIG. 10(*c*)), the abutting surface 1008 of the falling-off prevention mechanism 1000 abuts on the lower end surface 578 of the spacer 570, and the lower end surface b3 of the extension sleeve 430. In the golf club 110*c*, the lower end surface RT1 of the reverse-tapered engagement part RT is constituted by the lower end surface 578 and the lower end surface b3. The abutting surface 1008 abuts on the lower end surface RT1 (the lower end surface 578 and the lower end surface b3).

Thus, since the falling-off prevention mechanism 1000 abuts on the sleeve (including the extension sleeve) and the spacer, the moving of the reverse-tapered engagement part in the engagement releasing direction is regulated. As a result, falling off of the reverse-tapered engagement part is prevented. That is, falling off of the shaft 300 is prevented.

When the plate spring 1006 is pressed, the plate spring 1006 recedes such that the projection height Ht decreases. By the receding, the abutting surface 1008 is housed inside the head 250 so that the abutting surface 1008 cannot abut on the end face of the reverse-tapered engagement part. In this state, the reverse-tapered engagement part can be moved in the engagement releasing direction. Therefore, the shaft 300 can be detached from the head 250.

In the above-described fourth step (see FIG. 4), the reverse-tapered engagement part moves toward the reverse-tapered hole 205, while pressing the plate spring 1006. The pressed plate spring 1006 recedes to allow the reverse-tapered engagement part to move as described above. When the reverse-tapered engagement part reaches at a position where the reverse-tapered engagement part abuts on (is engaged with) the reverse-tapered hole 205, the reverse-tapered engagement part no longer presses the plate spring 1006 and the plate spring 1006 is projected. As a result, the abutting surface 1008 abuts on the lower end surface RT1 of the reverse-tapered engagement part RT, and thereby the falling-off prevention mechanism 1000 fulfills function thereof.

For releasing the function of the falling-off prevention mechanism 1000, press the plate spring 1006 by external force to release the abutting between the abutting surface 1008 and the lower end surface RT1. The external force is applied by a person's finger, for example.

Figure 17:
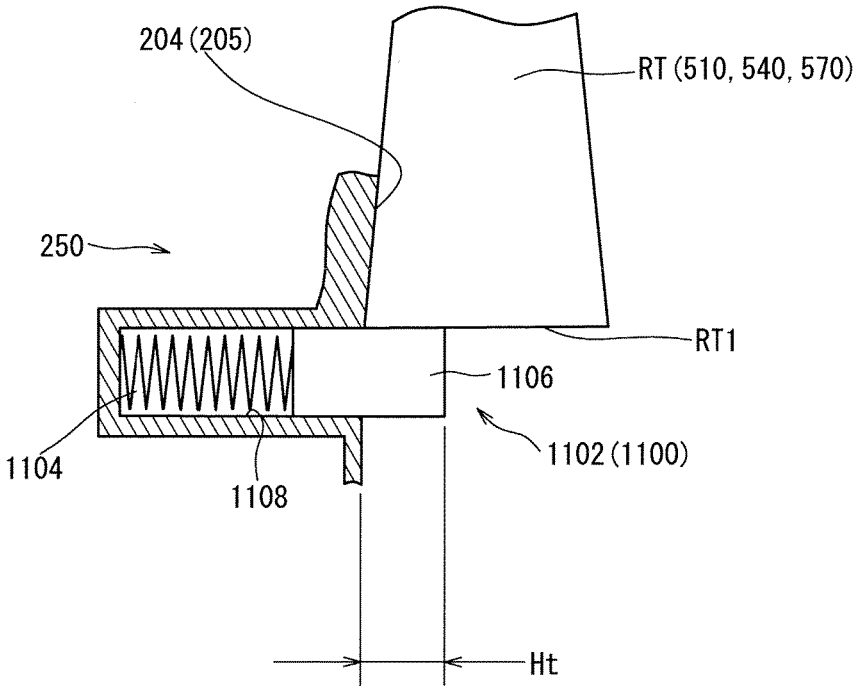
FIG. 17 is a sectional view of another falling-off prevention mechanism.

FIG. 17 is a sectional view of a falling-off prevention mechanism 1100 according to a modification example. As with the falling-off prevention mechanism 1000, the falling-off prevention mechanism 1100 has an elastic projection 1102 biased in a projecting direction under a condition where the elastic projection 1102 can project and recede. The elastic projection 1102 has a compression spring 1104, a sliding member 1106, and a sliding hole 1108. The sliding member 1106 is a cylindrical member, for example. The sliding hole 1108 is a circular hole, for example.

The compression spring 1104 biases the sliding member 1106 in a projecting direction. In a natural state where external force does not act, the sliding member 1106 is located at a position where the sliding member 1106 abuts on the lower end surface RT1. FIG. 17 shows the natural state. When the sliding member 1106 is pressed, the sliding member 1106 recedes such that a projection height Ht of the sliding member 1106 decreases. By the receding, engagement of the sliding member 1106 and the lower end surface RT1 is released. Thus, the function of the falling-off prevention mechanism 1100 is the same as that of the falling-off prevention mechanism 1000.

Other examples of the falling-off prevention mechanism include a detachable member which is detachably attached. In a golf club head in the engagement state, the detachable member is attached to a position which abuts on the lower end surface RT1. An attaching/detaching mechanism shown in JP2013-123439 is exemplified as an attaching/detaching mechanism including such a detachable member. A weight body shown in this gazette may be applied to the detachable member. For example, a structure in which the detachable member in an attached state (engaging position) is projected from the head body, and the projected portion abuts on the lower end surface RT1 can be adopted. A screw member is also exemplified as another detachable member.

Figure 18:
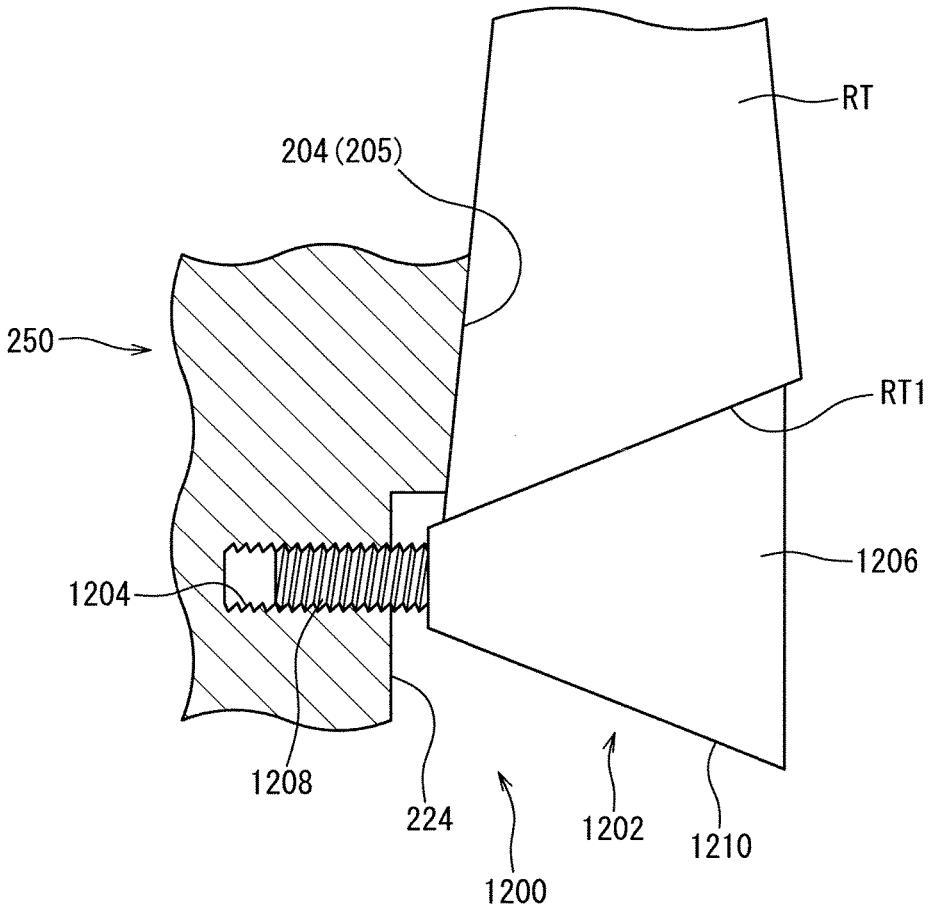
FIG. 18 is a sectional view showing an example of a falling-off prevention mechanism in which a screw member is used.

FIG. 18 shows an example of the falling-off prevention mechanism using a screw member. This falling-off prevention mechanism 1200 has a screw member 1202 and a screw hole 1204. The screw hole 1204 is provided on the extension surface 224. The screw member 1202 has a head part 1206 and a thread part 1208. A side surface 1210 of the head part 1206 has a tapered surface. The tapered surface 1210 is a conical surface (conically protruded surface). The tapered surface 1210 is coaxial with the thread part 1208. The tapered surface 1210 has an outer diameter which decreases toward the thread part 1208.

As shown in FIG. 18, the lower end surface RT1 of the reverse-tapered engagement part RT has an inclined surface which can be bought into line-contact with the tapered surface 1210.

In a state where the thread part 1208 is screwed into the screw hole 1204, the inclined surface of the lower end surface RT1 is brought into line-contact with the tapered surface 1210. The tapered surface 1210 is shifted by a screwed amount of the thread part 1208, and, by the shift, a contact position of the tapered surface 1210 and the lower end surface RT1 is shifted in the axial direction of the shaft. In the falling-off prevention mechanism 1200, the contact position of the lower end surface RT1 and the screw member 1202 can be finely adjusted with the screwed amount of the screw member 1202.

The lower end surface RT1 may be brought into surface-contact with the screw member. For example, in the screw member 1202, a structure in which the thread part 1208 is rotatably supported with respect to the head part 1206 can be adopted. For example, the head part 1206 may have a screw axis body having a thread part 1208 and a through hole, and a part of the screw axis body may be contained in the through hole. In the screw member, only the thread part 1208 can be rotated without rotating the head part 1206. For example, the lower end surface RT1 can be brought into surface-contact with the screw member when the side surface 1210 of the head part 1206 is a pyramid surface (four-sided pyramid surface).

Figure 19:
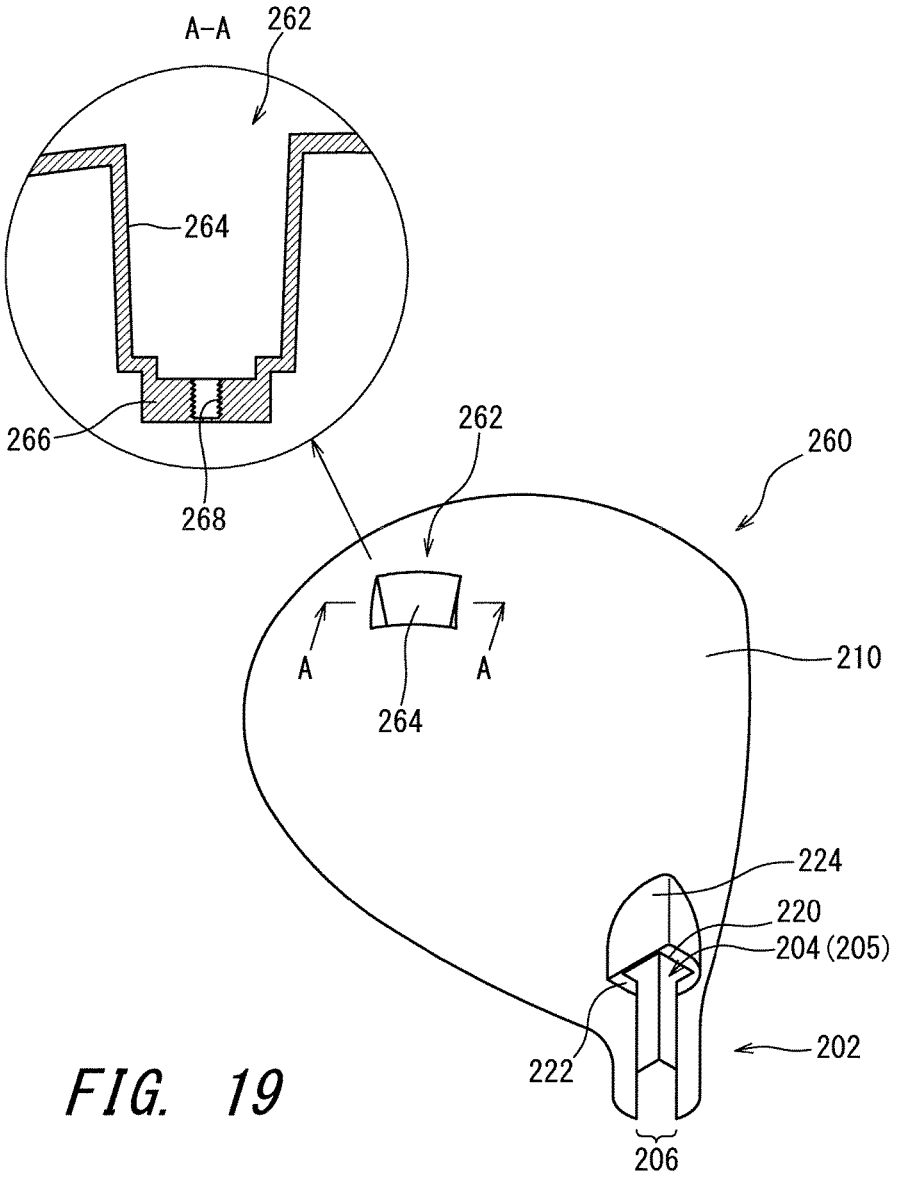
FIG. 19 is a perspective view of a head according to a third embodiment.

FIG. 19 is a perspective view of a head 260 according to a third embodiment. The head 260 is the same as the above-mentioned head 200 except for the presence of an extension-sleeve port detailed below.

The head 260 has a lower opening 220 located at the lower end of the reverse-tapered hole 205, an opening bottom surface 222 which extends in the axial orthogonal direction from the lower opening 220, and an extension surface 224 which extends toward the sole side from the opening bottom surface 222.

The head 260 has an extension-sleeve port 262. The extension-sleeve port 262 is provided on the sole 210. The extension-sleeve port 262 is a recessed part. The extension-sleeve port 262 is located at a toe side relative to the axis line of the shaft. The extension-sleeve port 262 is located at the toe side relative to a face center. The face center means a center of figure of the face surface in the planar view.

Figure 20B:
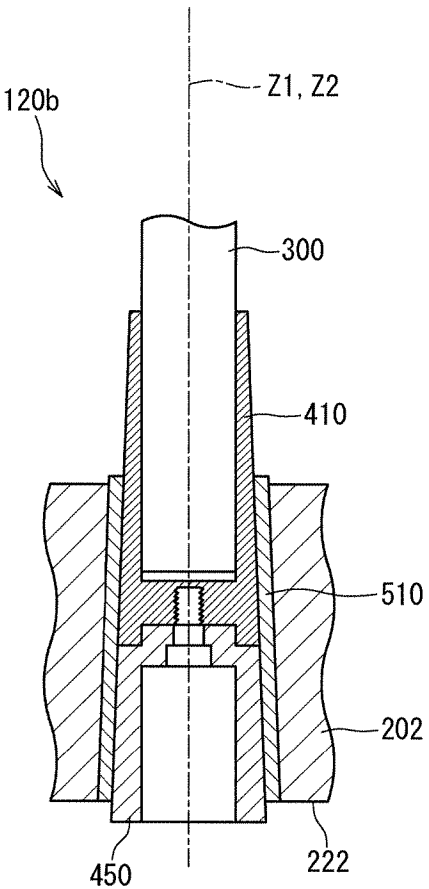
FIG. 20(*a*) and FIG. 20(*b*) are sectional views of a golf club having the head in FIG. 19.
Figure 20A:
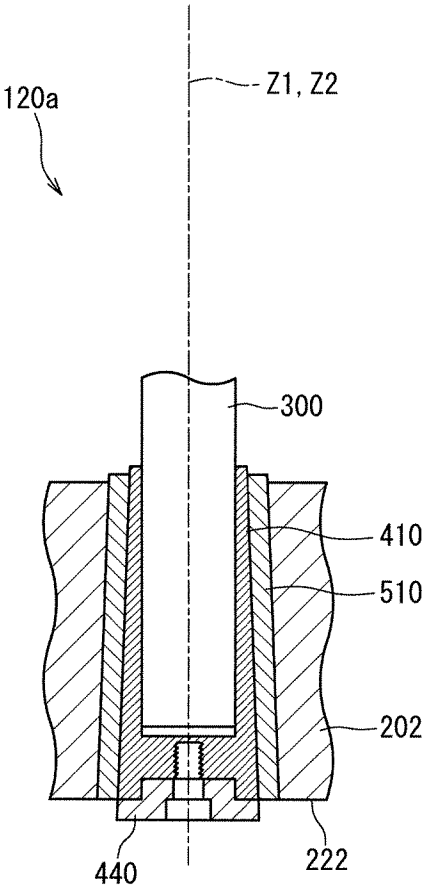

FIG. 20(*a*) and FIG. 20(*b*) are sectional views of a golf club 120 having the head 260. FIG. 20(*a*) shows a golf club 120*a* in a state where the club is short. FIG. 20(*b*) shows a golf club 120*b* in a state where the club is long.

The golf club 120*a* shown in FIG. 20(*a*) has an extension sleeve 440. Except for the presence of the extension sleeve 440, the golf club 120*a* is the same as the golf club 110*a* (FIG. 10(*a*)). The extension sleeve 440 is attached to a butt end portion of the sleeve 410. Although the extension sleeve 440 does not contribute to increase in the contact area with the spacer 510, the extension sleeve 440 plays the role of weight adjustment detailed below. Unlike the golf club 110*a*, in the golf club 120*a*, a butt end surface of the extension sleeve 440 is projected from the opening bottom surface 222.

The golf club 120*b* shown in FIG. 20(*b*) has an extension sleeve 450. The golf club 120*b* is the same as the golf club 110*b* (FIG. 10(*b*)) except that the extension sleeve 420 is replaced with the extension sleeve 450. The extension sleeve 450 is attached to the butt end portion of the sleeve 410.

The extension sleeve 450 (second extension sleeve) is longer than the extension sleeve 440 (first extension sleeve). This length means axial-direction length. The extension sleeve 450 (second extension sleeve) is heavier than the extension sleeve 440 (first extension sleeve).

The extension sleeve 440 can be attached to the extension-sleeve port 262. The extension sleeve 450 can be attached to the extension-sleeve port 262. All the extension sleeves 440 and 450 can be attached to the extension-sleeve port 262. The first extension sleeve 440 and the second extension sleeve 450 can be alternatively attached to the extension-sleeve port 262. The word "alternatively" means that any one of the extension sleeves can be attached.

The extension-sleeve port 262 completely houses all the extension sleeves 440 and 450. The extension-sleeve port 262 completely houses even the longest extension sleeve 450. The term "completely house" means that the extension sleeve attached to the extension-sleeve port 262 is not projected outside the outer surface of the sole 210. Therefore, the extension sleeve attached to the sole does not cause an inconvenience of increase in grounding resistance.

The enlarged portion of FIG. 19 is a sectional view of the extension-sleeve port 262. The extension-sleeve port 262 has a side surface 264 and a bottom part 266. The bottom part 266 has a screw hole 268. The screw hole 268 is the same as the screw hole 416 of the sleeve 410. The side surface 264 is a four-sided pyramid surface. An inner surface of the extension-sleeve port 262 has a shape corresponding to external shapes of the extension sleeve 440 and the extension sleeve 450.

The extension sleeve 440 can be fixed to the extension-sleeve port 262 by using a screw (referred to as a common screw) which is not shown in the drawings. The common screw is also a screw by which the extension sleeve 440 (and extension sleeve 450) is attached to the sleeve 410. Further, the extension sleeve 450 can be fixed to the extension-sleeve port 262 by using the common screw.

Thus, the golf club 120 has the plurality of (two) extension sleeves 440 and 450. The extension sleeve 440 (first extension sleeve) corresponds to the state where the club is short. The extension sleeve 450 (second extension sleeve) corresponds to the state where the club is long. The golf club 120 can take the following (state a) and (state b).

(State a) In the state (golf club 120*a*) where the club is short, the extension sleeve 440 (first extension sleeve) is attached to the sleeve 410, and the extension sleeve 450 (second extension sleeve) is attached to the extension-sleeve port 262 of the head 260.

(State b) In the state (golf club 120*b*) where the club is long, the extension sleeve 450 (second extension sleeve) is attached to the sleeve 410, and the extension sleeve 440 (first extension sleeve) is attached to the extension-sleeve port 262 of the head 260.

Generally, if a club is long, the face is apt be hard to turn. If the face does not sufficiently turn, the face opens upon impact and therefore the hit ball results in slice.

Generally, if a distance of a center of gravity is great, the face is apt to be hard to turn. The distance of the center of gravity means a distance between a center of gravity of the head and the axis line of the shaft.

In comparison between the golf club 120*a* in the state a and the golf club 120*b* in the state b, the club length of the state b is greater than that of the state a. On the other hand, the distance of the center of gravity of the state a is greater than that of the state b. This is because the extension sleeve 450 (second extension sleeve) is heavier than the extension sleeve 440 (first extension sleeve), and the extension-sleeve port 262 is disposed apart from the axis line of the shaft.

Thus, in the state a, although the distance of the center of gravity is long, the club is short. Meanwhile, in the state b, although the club is long, the distance of the center of gravity is short. For this reason, difference in degree of turn of the face between the state a and the state b is small. That is, the difference in degree of turn of the face between the two states is suppressed by offsetting the club length with the distance of the center of gravity. The golf club 120 fulfills a face-turn uniform effect. The face-turn uniform effect means that the difference in degree of turn of the face between the state where the club is long and the state where the club is short is small.

Therefore, in the golf club 120, variation in hit-ball direction, which is caused by changing club length, can be suppressed. For example, even when the club length is changed to "long" from "short", it is suppressed that the face becomes difficult to turn. Even also when the club length is changed to "short" from "long", it is suppressed that the face excessively turns.

The number of the extension-sleeve ports 262 may be one, and may be two or more. From a viewpoint that all the extension sleeves may be fixed to the club, the number of the extension-sleeve ports 262 is preferably equal to or greater than (N4−1). From a viewpoint of setting the number of the extension-sleeve ports 262 to the minimum, the number of the extension-sleeve ports 262 is preferably (N4−1). N4 means the number of the extension sleeves as mentioned above.

An engagement releasing direction and an engaging direction are defined in the present application. In the present application, the engagement releasing direction is a direction along with the axial direction, and a direction in which the reverse-tapered engagement part RT moves toward the sole side with respect to the reverse-tapered hole 205. In other words, the engagement releasing direction means a direction in which the reverse-tapered hole 205 moves toward the grip side with respect to the reverse-tapered engagement part RT. If the reverse-tapered engagement part RT is moved in the engagement releasing direction, the reverse-tapered engagement part RT comes out of the reverse-tapered hole 205. On the other hand, the engaging direction in the present application is a direction along with the axial direction, and a direction in which the reverse-tapered engagement part RT moves toward the grip side with respect to the reverse-tapered hole 205. In other words, the engaging direction means a direction in which the reverse-tapered hole 205 moves toward the sole side with respect to the reverse-tapered engagement part RT.

In the golf club in the engagement state, the reverse-tapered fitting is formed between the reverse-tapered engagement part RT and the reverse-tapered hole 205. A force in the engaging direction cannot release the reverse-tapered fitting, and on the contrary, can enhance the contact pressure of the reverse-tapered fitting. The force in the engaging direction further ensures the engagement between the reverse-tapered engagement part RT and the reverse-tapered hole 205.

The force in the engaging direction enhances the contact pressure of the sleeve and the spacer. The force in the engaging direction further ensures the engagement between the sleeve and the spacer.

A large force acting on the head of a golf club is a centrifugal force during swinging, and an impact shock force upon impact. Among these, the centrifugal force is the above-mentioned force in the engaging direction. Due to aloft angle of the head, a component force of the impact shock force in the axial direction is also the force in the engaging direction. Therefore, the centrifugal force and the impact shock force cannot release the engagement between the reverse-tapered engagement part RT and the reverse-tapered hole 205, and further ensures the engagement conversely. Since the reverse-tapered engagement part RT and the reverse-tapered hole 205 have a non-circular sectional shape, relative rotation between the reverse-tapered engagement part RT and the reverse-tapered hole 205 cannot occur. As a result, although the reverse-tapered engagement part RT and the reverse-tapered hole 205 are not fixed by an adhesive or the like, retention and anti-rotation required as a golf club are achieved. The structure of the reverse-tapered fitting can achieve both holding properties and attaching/detaching easiness.

Meanwhile, in situations other than swinging, the force in the engagement releasing direction may act on the golf club. Examples of the situations include a state where the golf club is inserted into a golf bag. In this state, the golf club is stood with the head up. In this case, the gravity acting on the head acts as the force in the engagement releasing direction. The force in the engagement releasing direction can be also produced when the head is put on the ground during addressing. Even if the force in the engagement releasing direction acts under the presence of the falling-off prevention mechanism, the head does not fall off.

The force in the engagement releasing direction is smaller than the force in the engaging direction caused by the centrifugal force and the impact shock force or the like. Therefore, a large force does not act on the falling-off prevention mechanism. The falling-off prevention mechanism may be a simple mechanism.

From the viewpoint of the Golf Rules, the falling-off prevention mechanism is preferably configured so as not to be released by bare hands. This configuration is attained, for example, by increasing the spring constant of the plate spring 1006 or the compression spring 1104. From the viewpoint of the Golf Rules, it is preferable that a special tool is required for the falling-off prevention mechanism.

The sleeve can be rotated about the axis line of the sleeve itself. The rotation position of the sleeve is changed by the rotation. In the engagement state, the sleeve can take a plurality of rotation positions. The number of the rotation positions which can be taken is set based on the shape of the outer surface of the sleeve.

The spacer can be rotated about the axis line of the spacer itself. The rotation position of the spacer is changed by the rotation. In the engagement state, the spacer can take a plurality of rotation positions. The number of the rotation positions which can be taken is set based on the shape of the outer surface of the spacer.

An axis line Z1 of the shaft hole (the axis line of the shaft) can be displaced with respect to the axis line of the outer surface of the sleeve. These axis lines may be inclined with respect to each other, or may be displaced in parallel to each other (parallel eccentric). Inclination and eccentricity may be combined. In this case, the direction and/or the position of the axis line of the shaft can be changed by the rotation position of the sleeve. A loft angle, a lie angle, a face angle (hook angle), a face progression, and the like can be adjusted by the change. In the above-described embodiments, the axis line Z1 of the shaft hole (the axis line of the shaft) coincides with the axis line of the outer surface of the sleeve (see FIG. 5(*a*) to FIG. 5(*c*) and FIG. 10(*a*) to FIG. 10(*c*)).

An axis line Z2 of the inner surface of the spacer can be displaced with respect to the axis line of the outer surface of the spacer. These axis lines may be inclined with respect to each other, or may be displaced in parallel to each other (parallel eccentric). Inclination and eccentricity may be combined. In this case, the direction and/or the position of the axis line of the shaft can be changed by the rotation position of the spacer. A loft angle, a lie angle, a face angle (hook angle), a face progression, and the like can be adjusted by the change. In the above-described embodiments, the axis line Z2 of the inner surface of the spacer coincides with the axis line of the outer surface of the spacer (see FIG. 5(*a*) to FIG. 5(*c*) and FIG. 10(*a*) to FIG. 10(*c*)).

The sectional area of the reverse-tapered hole of the hosel hole is increased toward the lower side (sole side). The sectional shape of the reverse-tapered hole is a non-circle. The sectional shape of the non-circle prevents relative rotation between the hosel hole and the reverse-tapered engagement part. The non-circle includes all shapes other than a circle. For example, the non-circle may be a shape having a projection, a recess, or a flat portion at at least a part in the circumferential direction of a circle. Preferably, the sectional shape of the reverse-tapered hole is a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In view of anti-rotation, the tetragon, the hexagon and the octagon are preferable. The sectional shape of the reverse-tapered hole is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In view of anti-rotation, the regular tetragon, the regular hexagon, and the regular octagon are more preferable.

The reverse-tapered hole preferably includes a plurality of surfaces. Each of the surfaces may be a plane surface, or may be a curved surface. From the viewpoint of ensuring surface-contact with the reverse-tapered engagement part, each of these surfaces is preferably a plane surface. From the viewpoint of ensuring surface-contact with the reverse-tapered engagement part, the reverse-tapered hole is preferably a pyramid surface. The pyramid surface means a part of an outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

The golf club has the sleeve. The inner surface (shaft hole) of the sleeve has the same shape as the shape of the tip portion of the shaft inserted into the sleeve. Usually, the sectional shape of the shaft hole is a circle. Typically, the inner surface (shaft hole) of the sleeve and the outer surface of the shaft are bonded by an adhesive.

The area of a figure formed by a sectional line of the outer surface of the sleeve is increased toward the lower side (sole side). The sectional shape of the outer surface of the sleeve is a non-circle. The sectional shape of the non-circle prevents relative rotation between the sleeve and an abutting portion. The abutting portion is the inner surface of the spacer or the reverse-tapered hole. When a plurality of spacers are present, the abutting portion is the inner surface of the innermost spacer. The non-circle includes all shapes other than a circle. For example, the non-circle may be a shape having a projection, a recess, or a flat portion at at least a part in the circumferential direction of a circle. Preferably, the sectional shape of the outer surface of the sleeve is a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the outer surface of the sleeve is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon (square), the regular hexagon and the regular octagon are more preferable.

The outer surface of the sleeve preferably includes a plurality of surfaces. Each of the surfaces may be a plane surface, or may be a curved surface. From the viewpoint of ensuring surface-contact with the abutting portion, each of these surfaces is preferably a plane surface. From the viewpoint of ensuring surface-contact with the abutting portion, the outer surface of the sleeve is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface, and the eight-sided pyramid surface are more preferable.

The golf club has one or more spacers. The inner surface of the spacer has the same shape as the shape of an outer surface of a member (inner member) fitted inside of the spacer. The inner member is the sleeve or another spacer.

The area of a figure formed by a sectional line of the inner surface of the spacer is increased toward the lower side (sole side). The sectional shape of the inner surface of the spacer is a non-circle. The sectional shape of the non-circle prevents relative rotation between the spacer and the inner member. When a plurality of spacers are present, the inner member is another spacer. The non-circle includes all shapes other than a circle. For example, the non-circle may be a shape having a projection, a recess, or a flat portion at at least a part in the circumferential direction of a circle. Preferably, the sectional shape of the inner surface of the spacer is a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the inner surface of the spacer is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are more preferable.

The inner surface of the spacer preferably includes a plurality of surfaces. Each of the surfaces may be a plane surface, or may be a curved surface. From the viewpoint of ensuring surface-contact with the inner member, each of these surfaces is preferably a plane surface. From the viewpoint of ensuring surface-contact with the inner member, the inner surface of the spacer is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface and the eight-sided pyramid surface are more preferable.

As described above, the club of the present disclosure has the reverse-tapered engagement part. The reverse-tapered engagement part includes the sleeve and one or more spacers. When one spacer is used, the outer surface of the reverse-tapered engagement part is the outer surface of the spacer. When two or more spacers are used, the outer surface of the reverse-tapered engagement part is the outer surface of the outermost spacer.

The area of a figure formed by a sectional line of the outer surface of the reverse-tapered engagement part is increased toward the lower side (sole side). The sectional shape of the outer surface of the reverse-tapered engagement part is a non-circle. The sectional shape of the non-circle prevents relative rotation between the reverse-tapered engagement part and the reverse-tapered hole. The non-circle includes all shapes other than a circle. For example, the non-circle may be a shape having a projection, a recess, or a flat portion at at least a part in the circumferential direction of a circle. Preferably, the sectional shape of the outer surface of the reverse-tapered engagement part is a polygon. Examples of the polygon include a triangle, a tetragon, a pentagon, a hexagon, a heptagon, an octagon, and a dodecagon. The polygon is preferably an N-sided polygon in which N is an even number, and examples of the N-sided polygon include the tetragon, the hexagon, the octagon, and the dodecagon. In light of anti-rotation, the tetragon, the hexagon and the octagon are preferable. The sectional shape of the outer surface of the reverse-tapered engagement part is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon in which N is an even number, and examples of the regular N-sided polygon include the regular tetragon (square), the regular hexagon, the regular octagon, and the regular dodecagon. In light of anti-rotation, the regular tetragon, the regular hexagon and the regular octagon are preferable.

The outer surface of the reverse-tapered engagement part preferably includes a plurality of surfaces. Each of the surfaces may be a plane surface, or may be a curved surface. From the viewpoint of ensuring surface-contact with the reverse-tapered hole, each of these surfaces is preferably a plane surface. From the viewpoint of ensuring surface-contact with the reverse-tapered hole, the outer surface of the reverse-tapered engagement part is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface in which N is an even number, and examples of the N-sided pyramid surface include the four-sided pyramid surface, the six-sided pyramid surface, the eight-sided pyramid surface, and the twelve-sided pyramid surface. In light of anti-rotation, the four-sided pyramid surface, the six-sided pyramid surface, and the eight-sided pyramid surface are more preferable.

Each of the above-mentioned numbers N is preferably an integer of equal to or greater than 3.

Thus, the reverse-tapered fitting is formed by the spacer and the reverse-tapered hole and the reverse-tapered fitting is also formed by the sleeve and the spacer simultaneously. By the force in the engagement releasing direction, the reverse-tapered fitting is easily released. In addition, the reverse-tapered fitting is easily formed by the force in the engaging direction. The shaft is easily attached to, and detached from the head. When the shaft is attached and detached, work for turning a screw is eliminated. There is no need to worry about loss of a screw.

The material of the sleeve is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic.

The material of the spacer is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic. From the viewpoint of moldability, the resin is preferable.

As described above, the golf club has a club length adjustment mechanism. The adjustment mechanism preferably satisfies the Golf Rules defined by R & A (The Royal and Ancient Golf Club of Saint Andrews). That is, the adjustment mechanism preferably satisfies requirements specified in "1b Adjustability" in "1. Clubs" of "Appendix II Design of Clubs" defined by R & A. The requirements specified in the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform to the Rules.

EXAMPLES

Hereinafter, the effects of the present disclosure will be clarified by Examples. However, the present disclosure should not be interpreted in a limited way based on the description of the Examples.

The same golf club as the above-mentioned golf club 100 was produced as Example. However, the spacer 800 shown in FIG. 7 was used for the golf club.

A head made of a titanium alloy was obtained by a known method. A reverse-tapered hole was formed by casting, and then finished to a predetermined size by NC process. A sleeve was made of an aluminum alloy. A process for manufacturing the sleeve was NC process.

A spacer was the same as the spacer 800 show in FIG. 7 and FIG. 8(*a*). The body of the spacer was made of an aluminum alloy. A process for manufacturing the body of the spacer was NC process. A connecting part 830 was made of a spring steel. As shown in FIG. 5(*a*) to FIG. 5(*c*), three spacers each having a different length L and a different wall thickness T were prepared.

A known carbon shaft was used as a shaft. The shaft was made to pass through one of the spacers, and the sleeve was then fixed to a tip portion of the shaft by an adhesive, to obtain a shaft assembly.

According to the procedure described in FIG. 4, the shaft assembly was mounted to the head to obtain a golf club in the engagement state. When a ball was actually hit by the golf club, retention and anti-rotation functioned completely, to obtain the same hitting as the hitting by a usual golf club. By replacing the attached spacer with the other spacers, the shaft length was adjusted to three kinds of lengths (see FIG. 5(*a*) to FIG. 5(*c*)).

The disclosure described above can be applied to all golf clubs such as a wood type golf club, a hybrid type golf club, an iron type golf club, and a putter.

The above description is merely illustrative example, and various modifications can be made without departing from the principles of the present disclosure.

What is claimed is:

1. A golf club kit including a golf club comprising:

a head having a hosel part;

a shaft; and a reverse-tapered engagement part disposed at a tip portion of the shaft, wherein:

the golf club kit further comprises a first spacer and a second spacer;

the reverse-tapered engagement part includes a sleeve having a reverse-tapered shape and being fixed to the tip portion of the shaft, and one of the spacers which is fitted outside of the sleeve;

the hosel part includes a hosel hole, and a hosel slit which is provided on a side of the hosel hole and enables the shaft to pass through the hosel slit;

the hosel hole has a reverse-tapered hole having a shape corresponding to a shape of an outer surface of the reverse-tapered engagement part;

the reverse-tapered engagement part is fitted to the reverse-tapered hole;

the first spacer has a wall thickness different from a wall thickness of the second spacer; and a length of the golf club is changed by replacing the spacer being used with the other spacer.

2. The golf club kit according to claim 1, wherein the first spacer has a length different from a length of the second spacer.

3. The golf club kit according to claim 1, wherein the reverse-tapered engagement part further includes at least one extension sleeve capable of being attached to a butt end of the sleeve; and the extension sleeve is fitted inside of the spacer being used while being attached to the butt end of the sleeve.

4. The golf club kit according to claim 3, wherein a recess is provided on a side surface of the extension sleeve.

5. The golf club kit according to claim 4, wherein an axial-direction position of a lower end surface of the reverse-tapered engagement part is the same regardless of the length of the golf club.

6. The golf club kit according to claim 3, including a first extension sleeve and a second extension sleeve as the extension sleeve; wherein the head has an extension-sleeve port to which the first extension sleeve and the second extension sleeve can be alternatively attached.

7. The golf club kit according to claim 6, wherein the second extension sleeve is longer than the first extension sleeve, and the second extension sleeve is heavier than the first extension sleeve.

8. The golf club kit according to claim 3, wherein the head further has a falling-off prevention mechanism, and the falling-off prevention mechanism has an abutting surface which abuts on a lower end surface of the extension surface.

9. The golf club kit according to claim 1, wherein the head further has a falling-off prevention mechanism, and the falling-off prevention mechanism has an abutting surface which abuts on a lower end surface of the reverse-tapered engagement part.

10. The golf club kit according to claim 1, wherein the reverse-tapered hole has a sectional area which is increased toward a lower side, an area of a figure formed by a sectional line of an outer surface of the sleeve is increased toward the lower side, an area of a figure formed by a sectional line of an inner surface of each of the spacers is increased toward the lower side, and an area of a figure formed by a sectional line of an outer surface of each of the spacers is increased toward the lower side.

11. The golf club kit according to claim 1, wherein a sectional shape of the reveres-tapered hole is a non-circle, a sectional shape of an outer surface of the sleeve is the non-circle, a sectional shape of an inner surface of each of the spacers is the non-circle, and a sectional shape of an outer surface of each of the spacers is the non-circle.

* * * * *